US009141081B2

(12) United States Patent
Hayakawa et al.

(10) Patent No.: US 9,141,081 B2
(45) Date of Patent: Sep. 22, 2015

(54) IMAGE FORMING APPARATUS PROVIDED WITH MECHANISM TO MOVE DEVELOPING ROLLER RELATIVE TO PHOTOSENSITIVE DRUM

(71) Applicants: Atsushi Hayakawa, Okazaki (JP); Atsuhisa Nakashima, Obu (JP); Naoya Kamimura, Ichinomiya (JP)

(72) Inventors: Atsushi Hayakawa, Okazaki (JP); Atsuhisa Nakashima, Obu (JP); Naoya Kamimura, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 39 days.

(21) Appl. No.: 14/032,609

(22) Filed: Sep. 20, 2013

(65) Prior Publication Data

US 2014/0093273 A1 Apr. 3, 2014

(30) Foreign Application Priority Data

Sep. 28, 2012 (JP) ..... 2012-218493

(51) Int. Cl.
*G03G 21/18* (2006.01)
*G03G 21/16* (2006.01)

(52) U.S. Cl.
CPC ..... *G03G 21/18* (2013.01); *G03G 21/1619* (2013.01); *G03G 21/1647* (2013.01); *G03G 21/1671* (2013.01)

(58) Field of Classification Search
USPC ..... 399/111
See application file for complete search history.

(56) References Cited

U.S. PATENT DOCUMENTS

| | | | | |
|---|---|---|---|---|
| 8,126,366 | B2 | 2/2012 | Hattori | |
| 2009/0169247 | A1 | 7/2009 | Hattori | |
| 2009/0190958 | A1 * | 7/2009 | Wang et al. | 399/228 |

FOREIGN PATENT DOCUMENTS

| | | | |
|---|---|---|---|
| JP | 2009-162915 | A | 7/2009 |

* cited by examiner

*Primary Examiner* — David Gray
*Assistant Examiner* — Michael Harrison
(74) *Attorney, Agent, or Firm* — Banner & Witcoff, Ltd.

(57) ABSTRACT

An image forming apparatus includes a main casing and a cartridge detachably mountable therein. The cartridge includes a photosensitive drum and a developing roller disposed to oppose each other. The main casing includes: a metal frame for supporting the cartridge; a lock member supported to the metal frame and movable about a first axis to allow or restrict movement of the photosensitive drum relative to the metal frame; and a contact-separation member supported to the metal frame and movable about a second axis to allow contact and separation of the developing roller relative to the photosensitive drum. The lock member and the contact-separation member are aligned in an orthogonal direction orthogonal to an axis of the photosensitive drum such that the first axis is not overlapped with the contact-separation member or the second axis is not overlapped with the lock member in an axial direction of the photosensitive drum.

12 Claims, 11 Drawing Sheets

IMAGE FORMING APPARATUS PROVIDED WITH MECHANISM TO MOVE DEVELOPING ROLLER RELATIVE TO PHOTOSENSITIVE DRUM

CROSS REFERENCE TO RELATED APPLICATION

This application claims priority from Japanese Patent Application No. 2012-218493 filed Sep. 28, 2012. The entire content of the priority application is incorporated herein by reference.

TECHNICAL FIELD

The present invention relates to an electrophotographic image forming apparatus.

BACKGROUND

One electrophotographic device known in the art is a printer provided with a main casing, and process cartridges that are detachably mounted in the main casing. Each process cartridge includes a drum cartridge that retains a photosensitive drum, and a developing cartridge that retains a developing roller for supplying toner to the corresponding photosensitive drum. This type of printer has been provided with a structure for bringing the developing roller in each developing cartridge to a position adjacent to the photosensitive drum of the corresponding drum cartridge in order to supply toner to the photosensitive drum during image formation, and for separating the developing roller from the photosensitive drum when not forming an image.

One example of this type of printer that has been proposed provides the main casing with left and right fixing members for fixing the photosensitive drums in position relative to the main casing, and separating members for placing the developing rollers in contact with the photosensitive drums and for separating the developing rollers from the corresponding photosensitive drums. The separating members are disposed inward of the respective left and right fixing members in the left-right direction and are rotatably supported on support parts provided on the respective left and right fixing members.

In the conventional printer having this construction, the left and right fixing members press against corresponding left and right ends of the photosensitive drums to fix the photosensitive drums in the main casing. When the photosensitive drums are fixed in position relative to the main casing, the separating members press against left and right ends of the developing rollers to separate the developing rollers from the photosensitive drums.

SUMMARY

However, in the conventional printer described above, the separating members are disposed on the left-right inner sides of the left and right fixing members and are rotatably supported on the support parts provided on the left and right fixing members. Hence, most of the separating members overlap the left and right fixing members in a left-right projection. For this reason, space must be allocated in the main casing of the conventional printer described above in order to juxtapose the separating members with the left and right fixing members in the left-right direction.

In view of the foregoing, it is an object of the present invention to provide an image forming apparatus capable of bringing together and separating developing rollers relative to photosensitive drums with the photosensitive drums being restricted from moving relative to the main casing, while achieving a more compact main casing in the axial direction of the photosensitive drums.

In order to attain the above and other objects, there is provided an image forming apparatus including a main casing and a cartridge attachable to and detachable from the main casing. The cartridge includes: a photosensitive drum defining a drum axis extending in an axial direction and configured to rotate about the drum axis; and a developing roller disposed to oppose the photosensitive drum. The main casing includes: a metal frame configured to support the cartridge; a lock member movably supported to the metal frame, attaching and detaching of the cartridge relative to the main casing being performed along a path, the lock member being configured to move about a first axis between a restricting position and a non-restricting position, the lock member at the restricting position protruding into the path and restricting the photosensitive drum from moving relative to the metal frame, and the lock member at the non-restricting position being retracted from the path and allowing the photosensitive drum to move relative to the metal frame; and a contact-separation member movably supported to the metal frame and configured to move about a second axis between a contact position and a separation position, the contact-separation member at the contact position causing the developing roller to contact the photosensitive drum and the contact-separation member at the separation position causing the developing roller to be separated from the photosensitive drum. The lock member and the contact-separation member are aligned in an orthogonal direction orthogonal to the axial direction such that at least one of first and second conditions is satisfied: the first condition is that the first axis is not overlapped with the contact-separation member when viewed in the axial direction; and the second condition is that the second axis is not overlapped with the lock member when viewed in the axial direction.

DETAILED DESCRIPTION

1. Overall Structure of Printer

Figure 1:
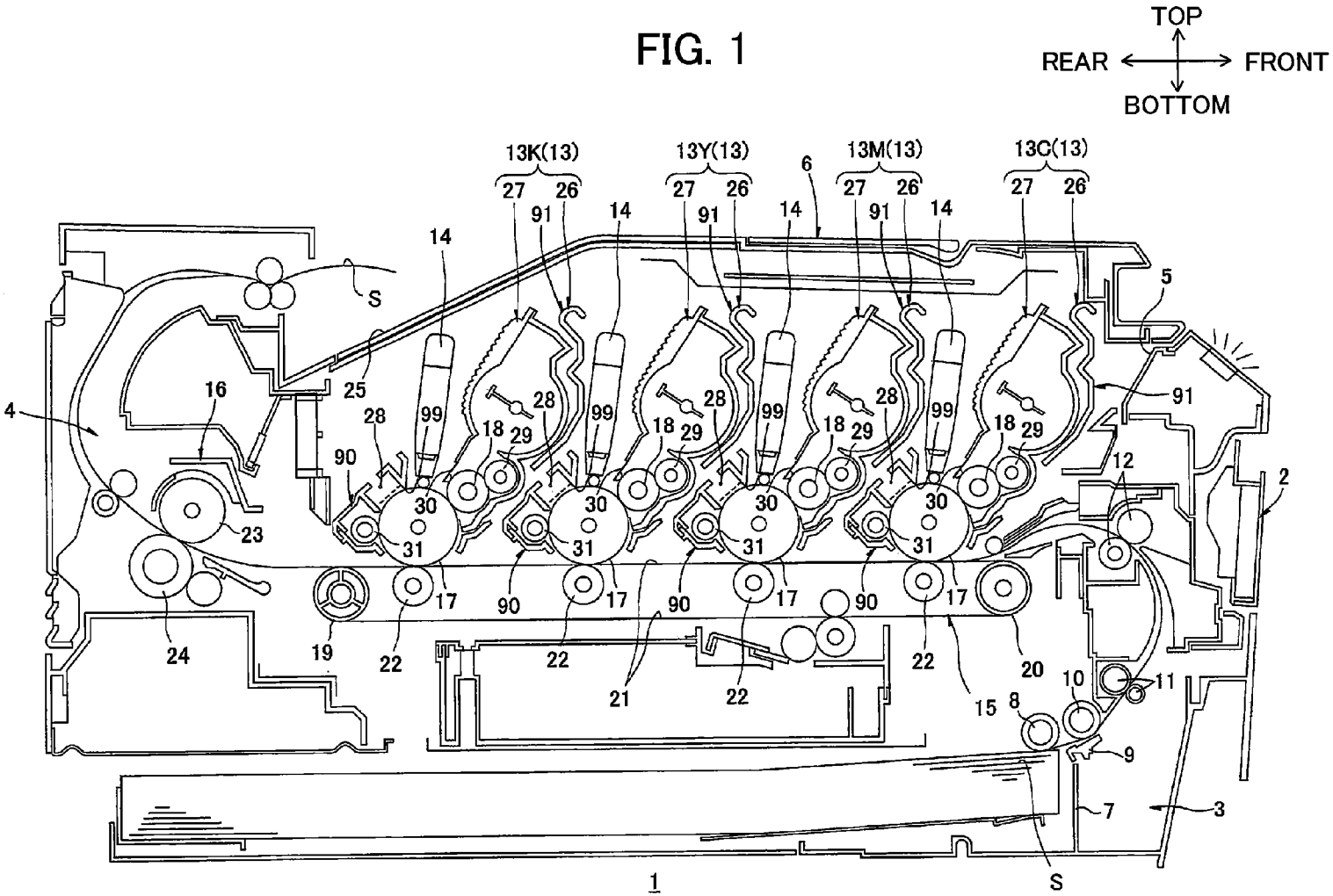
FIG. 1 is a vertical cross-sectional view of a printer as an example of an image forming apparatus according to an embodiment of the present invention, the printer accommodating a plurality of process cartridges therein.

A printer 1 is a direct horizontal tandem-type color printer, as shown in FIG. 1. The printer 1 is an example of an image forming apparatus according to an embodiment of the present invention.

Directions used in the following description in relation to the printer 1 will reference the state of the printer 1 when the printer 1 is resting on a level surface, where the upper side of the printer 1 in FIG. 1 is considered the "upper side", and the lower side in FIG. 1 is considered the "lower side". Further, the right side of the printer 1 in FIG. 1 will be called the "front", and the left side the "rear". Left and right sides of the printer 1 will be defined based on the perspective of a user facing the front of the printer 1. Thus, the near side of the printer 1 in FIG. 1 will be considered the "left side", and the far side will be considered the "right side".

The printer 1 includes a main casing 2, within which disposed are a sheet feeding unit 3 for feeding sheets of paper S and an image forming unit 4 for forming images on the sheets of paper S.

(1) Main Casing

The main casing 2 has a box-like shape. An access opening 5 is formed in a top portion of the main casing 2. A top cover 6 is pivotably disposed on the top portion of the main casing 2 over the access opening 5. The top cover 6 is pivotally movable about its rear edge between a closed position (FIG. 1) to cover the access opening 5 and an open position to expose the access opening 5.

(2) Sheet Feeding Unit

The sheet feeding unit 3 includes a paper tray 7 for accommodating the sheets S of paper. The paper tray 7 is detachably provided in a bottom section of the main casing 2.

A pickup roller 8 rotates to pick up sheets S accommodated in the paper tray 7 and to convey the sheets S out of the paper tray 7 toward a separating pad 9 and a separating roller 10. Friction produced between the separating pad 9 and the rotating separating roller 10 separates the sheets S. Subsequently, rotating conveying rollers 11 convey the separated sheets S one sheet at a time toward a pair of registration rollers 12 disposed above the conveying rollers 11. The registration rollers 12 rotate to convey the sheets S at a prescribed timing toward the image forming unit 4 so that each sheet S passes between photosensitive drums 17 and a conveyor belt 21, both described later.

(3) Image Forming Unit

The image forming unit 4 includes four process cartridges 13, four LED units 14, a transfer unit 15 and a fixing unit 16.

(3-1) Process Cartridge

The four process cartridges 13 are provided for each of four colors (black, yellow, magenta, and cyan). The process cartridges 13 are disposed in parallel and spaced at intervals in a front-rear direction above the paper tray 7.

Specifically, the four process cartridges 13 are juxtaposed in the front-rear direction and include, in order from the rear side to the front side, a black process cartridge 13K, a yellow process cartridge 13Y, a magenta process cartridge 13M and a cyan process cartridge 13C.

The process cartridges 13 are detachably mountable in the main casing 2. Each process cartridge 13 includes a drum cartridge 26 and a developing cartridge 27.

The drum cartridges 26 are detachably mountable in the main casing 2. Each drum cartridge 26 is provided with a photosensitive drum 17, a Scorotron charger 28, and a cleaning roller 31.

The photosensitive drum 17 has a general cylindrical shape, with its axis aligned in a left-right direction. The photosensitive drum 17 is rotatably disposed in the drum cartridge 26.

The Scorotron charger 28 is disposed upward and rearward of the corresponding photosensitive drum 17 so as to confront the same with a space therebetween.

The cleaning roller 31 is disposed beneath the Scorotron charger 28 at a position for contacting the corresponding photosensitive drum 17 on its rear side.

The developing cartridges 27 are detachable mountable on the respective drum cartridges 26.

Each of the developing cartridges 27 is provided with a developing roller 18, a supply roller 29, and a thickness-regulating blade 30.

The developing roller 16 has a general columnar shape that is elongated in the left-right direction. The developing roller 18 is disposed in a lower end of the developing cartridge 27 and is exposed outside the developing cartridge 27 through the lower rear side thereof. The developing roller 18 contacts the photosensitive drum 17 on the upper front side thereof.

The developing cartridge 27 also stores toner. The supply roller 29 is configured to supply the toner to the developing roller 18 and the thickness-regulating blade 30 serves to regulate a thickness of the toner supplied onto the developing roller 18. The toner stored in a portion of the developing cartridge 27 above the developing roller 18, the supply roller 29 and the thickness-regulating blade 30.

(3-2) LED Unit Four of the LED units 14 are provided to correspond to the four photosensitive drums 17. Each LED unit 14 is disposed so as to face the top of the corresponding photosensitive drum 17.

(3-3) Transfer Unit

The transfer unit 15 is disposed above the paper tray 7 but below the process cartridges 13 to extend in the front-rear direction.

The transfer unit 15 includes a drive roller 19, a follow roller 20, the conveyor belt 21 and four transfer rollers 22.

The drive roller 19 and the follow roller 20 oppose and are spaced away from each other in the front-rear direction.

The conveyor belt 21 is mounted on the drive roller 19 and the follow roller 20 in a tout state such that the conveyor belt 21 has an upper portion opposes and contacts bottom surfaces of the photosensitive drums 17.

When the drive roller 19 is driven to rotate, the conveyor belt 21 circulates so that the upper portion of the conveyor belt 21 that contacts the photosensitive drums 17 moves rearward.

The four transfer rollers 22 are provided to correspond to the four photosensitive drums 17. Each of the transfer rollers 22 confronts the corresponding photosensitive drum 17 with the upper portion of the conveyor belt 21 interposed therebetween.

(3-4) Fixing Unit

The fixing unit 16 is dispose rearward of the transfer unit 15, and includes a heat roller 23 and a pressure roller 24 in pressure contact with the heat roller 23.

(4) Image Forming Operation

The toner accommodated in the developing cartridge 27 is supplied to the supply roller 29, and tribocharged with a positive polarity between the supply roller 29 and developing roller 18 when supplied onto the surface of the developing roller 18. The thickness-regulating blade 30 then maintains the toner carried on the surface of the developing roller 18 at a thin layer of uniform thickness, as the developing roller 18 rotates.

In the meantime, the Scorotron charger 28 applies a uniform charge to a peripheral surface of the photosensitive drum 17. Subsequently, the LED unit 14 irradiates light onto the surface of the photosensitive drum 17 based on prescribed image data, forming an electrostatic latent image on the surface. Next, the toner carried on the surface of the developing roller 18 is supplied to the latent image formed on the surface of the photosensitive drum 17, developing the latent image into a toner image.

At the same time, one sheet S supplied from the sheet feeding unit 3 onto the conveyor belt 21 is conveyed rearward by the conveyor belt 21. The toner images of all four colors are sequentially transferred onto the sheet S as the sheet S passes between the photosensitive drums 17 and their corresponding transfer rollers 22 to form a color image on the sheet S.

The toner images (color image) transferred from the peripheral surfaces of the photosensitive drums 17 are subsequently fixed to the sheet S by heat and pressure as the sheet S passes between the heat roller 23 and pressure roller 24. Through this process, the color image transferred onto the sheet S is fixed to the sheet S.

The sheet S is then conveyed along a U-shaped path that redirects the sheet S upward and forward, and the sheet S is discharged onto a discharge tray 25 provided on the top cover 6.

2. Process Cartridges

In the following description related to the process cartridge 13, the side of the process cartridge 13 on which the photosensitive drum 17 is provided will be called the "rear side," and the side on which the Scorotron charger 28 is provided will be called the "upper side." Hence, vertical and front-rear directions related to the process cartridge 13 differ from the vertical and front-rear directions related to the printer 1. More specifically, the process cartridge 13 is mounted in the printer 1 such that its front side corresponds to the upper front side of the printer 1, its rear side corresponds to the lower rear side of the printer 1, its upper side corresponds to the upper rear side of the printer 1, and its lower side corresponds to the lower front side of the printer 1.

(1) Drum Cartridges

Figure 2A:
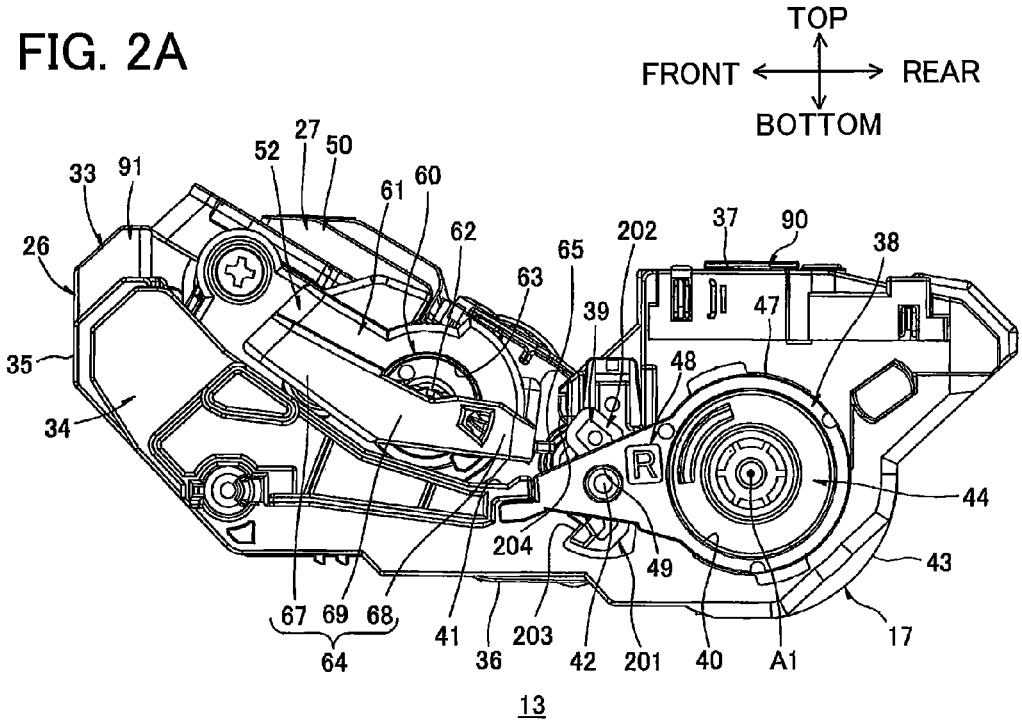
FIG. 2A is a right side view of the process cartridge according to the embodiment of the present invention.
Figure 2B:
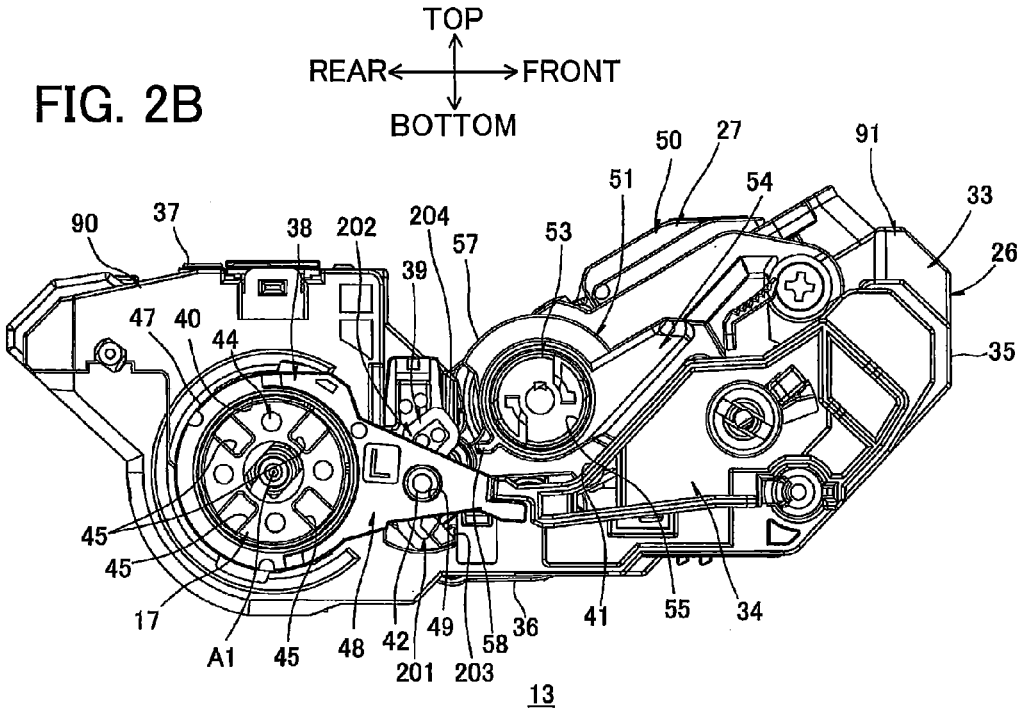
FIG. 2B is a left side view of the process cartridge according to the embodiment of the present invention.

As shown in FIGS. 2A and 2B, each drum cartridge 26 has a drum-cartridge frame 33.

(1-1) Drum-Cartridge Frame

The drum-cartridge frame 33 has a frame-like shape with a closed bottom and is generally rectangular in a plan view. The drum-cartridge frame 33 is configured of a pair of left and right side walls 34, a front wall 35, a bottom wall 36, and a top wall 37.

The side walls 34 are arranged parallel to each other and spaced apart in the left-right direction. The side walls 34 are generally rectangular in a side view and elongated in the front-rear direction. A flange insertion hole 40 and an exposing groove 41 are formed in each side wall 34.

The flange insertion hole 40 has a general circular shape in a side view. The flange insertion hole 40 is formed in a rear end of the side wall 34 and penetrates the side wall 34 in the left-right direction. The flange insertion hole 40 has a diameter approximately equal to an outer diameter of a flange member 44 described later.

The exposing groove 41 is formed in a front portion of the side wall 34. The exposing groove 41 has a general V-shape in a side view and is cut out from the upper edge thereof.

A support shaft 42 is also provided on each side wall 34. The support shafts 42 are disposed forward of the corresponding flange insertion holes 40 and obliquely downward and rearward from the corresponding exposing grooves 41. The support shafts 42 have a general columnar shape and extend outward in the left-right direction from respective outer surfaces of the side walls 34.

The front wall 35 has a generally flat plate shape that expands in vertical and left-right directions. The front wall 35 bridges respective front ends of the side walls 34.

The bottom wall 36 has a generally flat plate shape that expands in the front-rear and left-right directions. The bottom wall 36 bridges respective lower edges of the side walls 34. The bottom wall 36 has a front edge that is formed continuously with a bottom edge of the front wall 35.

The top wall 37 has a generally flat plate shape that expands in the front-rear and left-right directions. The top wall 37 bridges respective upper edges of the side walls 34 at the rear ends thereof so as to cover the top of the corresponding photosensitive drum 17. The Scorotron charger 28 is supported on the top wall 37.

The rear portion of the drum-cartridge frame 33 constitutes a drum-accommodating section 90, while the front portion constitutes a developing-cartridge-accommodating section 91.

(1-2) Drum-Accommodating Section

The drum-accommodating section 90 is defined by the rear portions of the side walls 34, the rear portion of the bottom wall 36, and the top wall 37 and has a box-like shape that is open on both front and rear sides. The drum-accommodating section 90 is provided with the photosensitive drum 17 and a pair of bearing members 38.

Each photosensitive drum 17 is configured of a drum body 43, and a pair of (left and right) flange members 44.

The drum body 43 is formed of a metal in a general cylindrical shape and is oriented with its axis in the left-right direction. The outer surface of the drum body 43 is coated with a layer of photosensitive resin.

The flange members 44 have a general columnar shape that is elongated in the left-right direction. As shown in FIG. 2B, the left flange member 44 is fitted into a left end of the drum body 43 so as to be incapable of rotating relative to the drum body 43. Further, a plurality of coupling fitting parts 45 is formed in a left surface of the left flange member 44.

More specifically, four of the coupling fitting parts 45 are formed in the left surface of the left flange member 44 around the outer circumference thereof at intervals of 90 degrees in the circumferential direction. The coupling fitting parts 45 are formed as recesses in the left surface of the left flange member 44 and are generally rectangular in a side view. A distal end of a body-side drum coupling (not shown) provided in the main casing 2 is inserted into the coupling fitting parts 45 when the process cartridge 13 is mounted in the main casing 2 so as to be incapable of rotating relative to the left flange member 44. A rotational drive force is inputted into the coupling fitting parts 45 via the body-side drum coupling.

As shown in FIG. 2A, the right flange member 44 is fitted into a right end of the drum body 43 so as to be incapable of rotating relative thereto.

The photosensitive drum 17 is accommodated in the drum-accommodating section 90 with the left and right flange members 44 inserted into the flange insertion holes 40 formed in the corresponding side walls 34. In this state, the left and right flange members 44 pass through the flange insertion holes 40 and protrude outward in the left-right direction from the corresponding side walls 34.

As shown in FIGS. 2A and 2B, one bearing member 38 is supported in the rear portion of each side wall 34 such that the bearing member 38 is disposed outward of the rear portion in the left-right direction. Each bearing member 38 is integrally configured of a shaft-receiving part 47 and a shaft-engaging part 48.

The shaft-receiving part 47 has a general cylindrical shape that is elongated in the left-right direction. The shaft-receiving part 47 has an inner diameter approximately equal to an outer diameter of the flange member 44.

The shaft-engaging part 48 has a generally flat plate shape that is substantially triangular in a side view and protrudes forward from the front side of the shaft-receiving part 47 on the outer left-right end thereof. A fitting hole 49 is formed in the shaft-engaging part 48.

The fitting hole 49 has a general circular shape in a side view and penetrates a generally front-rear center portion of the shaft-engaging part 48. The fitting hole 49 has a diameter that is approximately equal to an outer diameter of the support shaft 42.

Each bearing member 38 is fixed to the outer surface of the corresponding side wall 34 such that the shaft-receiving part 47 is fitted around the corresponding flange member 44 (fitted radially outside the flange member 44) so as to be incapable of rotating relative to the flange member 44, and the fitting hole 49 is fitted around the outer left-right end (fitted over the radial outside) of the corresponding support shaft 42. With this configuration, the photosensitive drum 17 is rotatably supported in the drum-cartridge frame 33 through the bearing members 38. Accordingly, when a drive force is inputted into the coupling fitting parts 45, the photosensitive drum 17 rotates about an axis A1 aligned in the left-right direction (see FIGS. 2A and 2B).

(1-3) Developing-Cartridge-Accommodating Section

The developing-cartridge-accommodating section 91 is specifically defined by the front portions of both side walls 34, the front portion of the bottom wall 36, and the front wall 35. The developing-cartridge-accommodating section 91 has a box-like shape that is open on the top for allowing the corresponding developing cartridge 27 to be detachably mounted therein.

The drum-accommodating section 90 and developing-cartridge-accommodating section 91 are in communication with each other through a cartridge opening 99 shown in FIG. 1. The cartridge opening 99 is defined by the front portion of the top wall 37, the top surface of the bottom wall 36, and the inner left-right side surfaces of the respective side walls 34.

As shown in FIGS. 2A and 2B, the developing-cartridge-accommodating section 91 is further provided with a pair of separating members 39, and pressing members (not shown).

Figure 5:
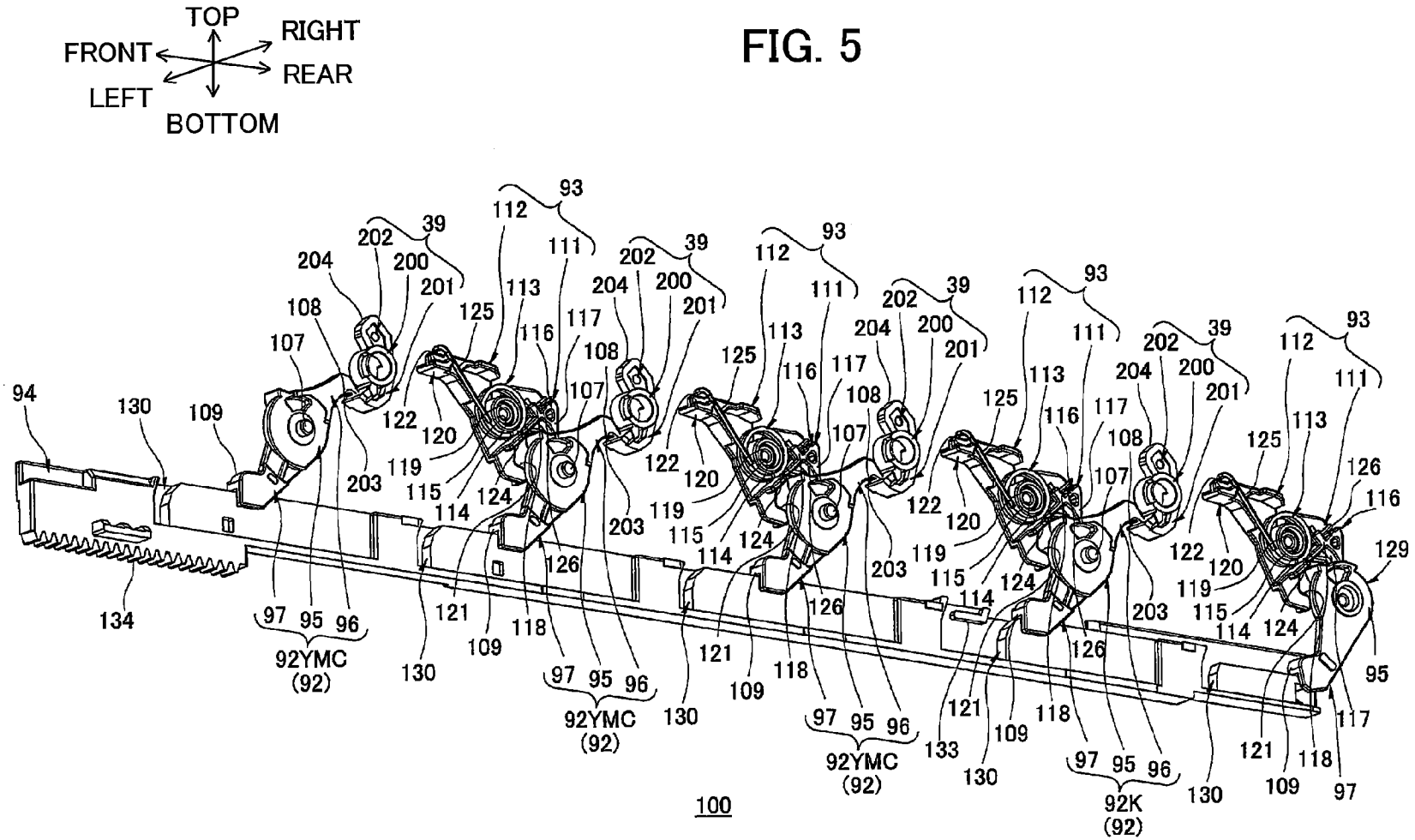
FIG. 5 is a perspective view of a contact/separation locking mechanism provided in the printer according to the embodiment of the present invention as viewed from a point rightward and downward of the contact/separation locking mechanism.

Each of the separating members 39 is disposed on the outside of each side wall 34 in the left-right direction at a position frontward of the flange insertion hole 40 and rearward of the exposing groove 41. As shown in FIG. 5, the separating members 39 have a generally flat plate shape that is substantially V-shaped in a side view with the opening of the "V" facing forward. Each separating member 39 is integrally configured of a shaft insertion part 200, a lower fin 201, and an upper fin 202.

The shaft insertion part 200 has a general cylindrical shape that is elongated in the left-right direction. The shaft insertion part 200 has an inner diameter that is approximately equal to the outer diameter of the support shaft 42.

The lower fin 201 has a generally flat plate shape that extends downward from a bottom end of the shaft insertion part 200. The lower fin 201 has a lower portion that curves forward. The lower portion of the lower fin 201 has a front surface that constitutes a pressure-receiving surface 203. The pressure-receiving surface 203 receives pressure from a contact/separation lever 92 (described later) when a developing-cartridge frame 50 (described later) is disposed in a separated position (described later).

The upper fin 202 has a generally flat plate shape that extends upward from a top end of the shaft insertion part 200. The upper fin 202 has an upper portion that curves forward. The upper portion of the upper fin 202 has a front surface that constitutes a contact surface 204. The contact surface 204 contacts either a separation contact part 58 (described later) or a separation contact part 65 (described later) when the developing-cartridge frame 50 is in the separated position, as will be described later.

As shown in FIGS. 2A and 2B, the separating members 39 are disposed respectively between each side wall 34 and corresponding shaft-engaging part 48. Each separating member 39 is pivotally movably supported on the support shaft 42 by inserting the support shaft 42 into the corresponding shaft insertion part 200. The pressing members (not shown) are embedded in the rear surface of the front wall 35 with one positioned in each of the left and right sides thereof, and are slidably movably supported on the front wall 35 so as to be capable of sliding in the front-rear direction. The pressing members have a generally square cylindrical shape elongated in the front-rear direction. A compression coil spring (not shown) is accommodated in a space within this cylindrical shape and is capable of expanding and retracting in a direction in which the pressing members slide (in the front-rear direction). The compression coil springs constantly urge the corresponding pressing members rearward.

(2) Developing Cartridges

The developing cartridge 27 has a developing-cartridge frame 50, a drive unit 51, and a power-supply unit 52.

The developing-cartridge frame 50 has a box-like shape and is elongated in the left-right direction. The developing-cartridge frame 50 is open on its rear side. Inside the developing-cartridge frame 50 are accommodated a corresponding developing roller 18, and toner. The developing roller 18 is rotatably supported in a rear end portion of the developing-cartridge frame 50 (see FIG. 1) and is exposed on the rear side thereof.

As shown in FIG. 2B, the drive unit 51 is disposed on the left side of the developing-cartridge frame 50. The drive unit 51 includes a development coupling 53, and a drive-side cover 54.

The development coupling 53 has a general columnar shape that is elongated in the left-right direction. The development coupling 53 is rotatably accommodated inside the drive-side cover 54. A coupling recession 55 is formed in a left endface of the development coupling 53.

The coupling recession 55 is recessed into the left endface of the development coupling 53. When the developing cartridge 27 is mounted in the main casing 2, a distal end of a body-side development coupling (not shown) provided in the main casing 2 is inserted into the corresponding coupling recession 55 so as to be incapable of rotating relative to the development coupling 53. A rotational drive force from the main casing 2 is inputted into the coupling recession 55 via the body-side development coupling. The rotational drive force inputted into the development coupling 53 is then transmitted to the developing roller 18 and supply roller 29 via a gear train (not shown).

The drive-side cover 54 has a generally square cylindrical shape that is elongated in the left-right direction and closed on the left end. The drive-side cover 54 includes a coupling collar 57, and a separation contact part 58.

The coupling collar 57 has a general cylindrical shape and protrudes leftward from a left wall of the drive-side cover 54 at an approximate front-rear center thereof. The right end of the coupling collar 57 is in communication with an interior of the drive-side cover 54.

The separation contact part 58 has a ridge-like shape elongated in the left-right direction and protruding rearward from a rear edge of the coupling collar 57.

The drive-side cover 54 is fastened to the left wall of the developing-cartridge frame 50 with screws such that the left end of the development coupling 53 is fitted inside the coupling collar 57. The coupling recession 55 is thus exposed through the left end of the coupling collar 57.

As shown in FIG. 2A, the power-supply unit 52 is disposed on the right side of the developing-cartridge frame 50. The power-supply unit 52 includes an electrode member 60, and a supply-side cover 61.

The electrode member 60 is formed of an electrically conductive resin material, such as a conductive polyacetal resin. The electrode member 60 is supported on a right wall of the developing-cartridge frame 50 inside the supply-side cover 61. The corresponding developing roller 18 and supply roller 29 are electrically connected to the electrode member 60. The electrode member 60 includes a power-receiving part 62.

The power-receiving part 62 has a general cylindrical shape that extends in the left-right direction. The power-receiving part 62 contacts a body-side electrode (not shown) provided in the main casing 2 when the developing cartridge 27 is mounted in the main casing 2, enabling power to be supplied from the body-side electrode to the power-receiving part 62. Power supplied to the power-receiving part 62 (an electrical bias) is applied to both the developing roller 18 and supply roller 29 through the electrode member 60.

The supply-side cover 61 has a general cylindrical shape that extends in the left-right direction and is closed on the right end. The supply-side cover 61 includes a power-receiving-part exposing hole 63, a power-receiving-part protection part 64, and a separation contact part 65.

The power-receiving-part exposing hole 63 is generally circular in a side view and penetrates the right wall of the supply-side cover 61 at an approximate front-rear center thereof for exposing the right end of the power-receiving part 62.

The power-receiving-part protection part 64 integrally includes a front protection part 67, a rear protection part 68, and a right protection part 69.

The front protection part 67 has a generally square columnar shape and protrudes rightward from a front peripheral edge of the power-receiving-part exposing hole 63. The rear protection part 68 has a generally square columnar shape and protrudes rightward from a rear peripheral edge of the power-receiving-part exposing hole 63. The right protection part 69 has a generally flat plate shape extending in the front-rear direction for bridging right ends of the front protection part 67 and rear protection part 68. The right protection part 69 opposes the right endface of the power-receiving part 62.

The separation contact part 65 has a ridge-like shape that extends in the left-right direction and protrudes rearward from a rear end of the rear protection part 68.

The supply-side cover 61 is fixed to the right side wall 34 with screws such that the right end of the power-receiving part 62 is exposed through a gap between the front protection part 67 and rear protection part 68.

(3) Mounting Developing Cartridge in Drum Cartridge

The developing cartridge 27 is mounted in the developing-cartridge-accommodating section 91 of the corresponding drum-cartridge frame 33. Through this construction, the developing cartridge 27 is accommodated in the drum cartridge 26 to form the process cartridge 13.

When the developing cartridge 27 is mounted in the developing-cartridge-accommodating section 91, the separation contact part 65 of the drive unit 51 and the separation contact part 58 of the power-supply unit 52 are positioned outside the side walls 34 in the left-right direction through the exposing grooves 41 and are positioned frontward of the corresponding separating members 39 to be separated therefrom.

In addition, the pressing members (not shown) contact left and right ends on the front wall of the developing-cartridge frame 50 to press the developing cartridge 27 rearward. Consequently, the developing cartridge 27 is disposed in a contact position shown in FIG. 7 in which the developing roller 18 and photosensitive drum 17 oppose and contact each other through the cartridge opening 99.

However, as will be described later in greater detail, when the separating members 39 press against the corresponding separation contact part 58 and separation contact part 65 (see FIG. 10), the developing cartridge 27 moves obliquely upward and forward relative to the drum-cartridge frame 33 and against the urging force of the pressing members. As a result, the developing cartridge 27 is disposed in the separated position shown in FIGS. 9 and 10 in which the developing roller 18 is separated from the corresponding photosensitive drum 17. Hence, the developing cartridge 27 can be moved between the contact position and the separated position.

3. Main Casing (1) Main Side Walls

Figure 3:
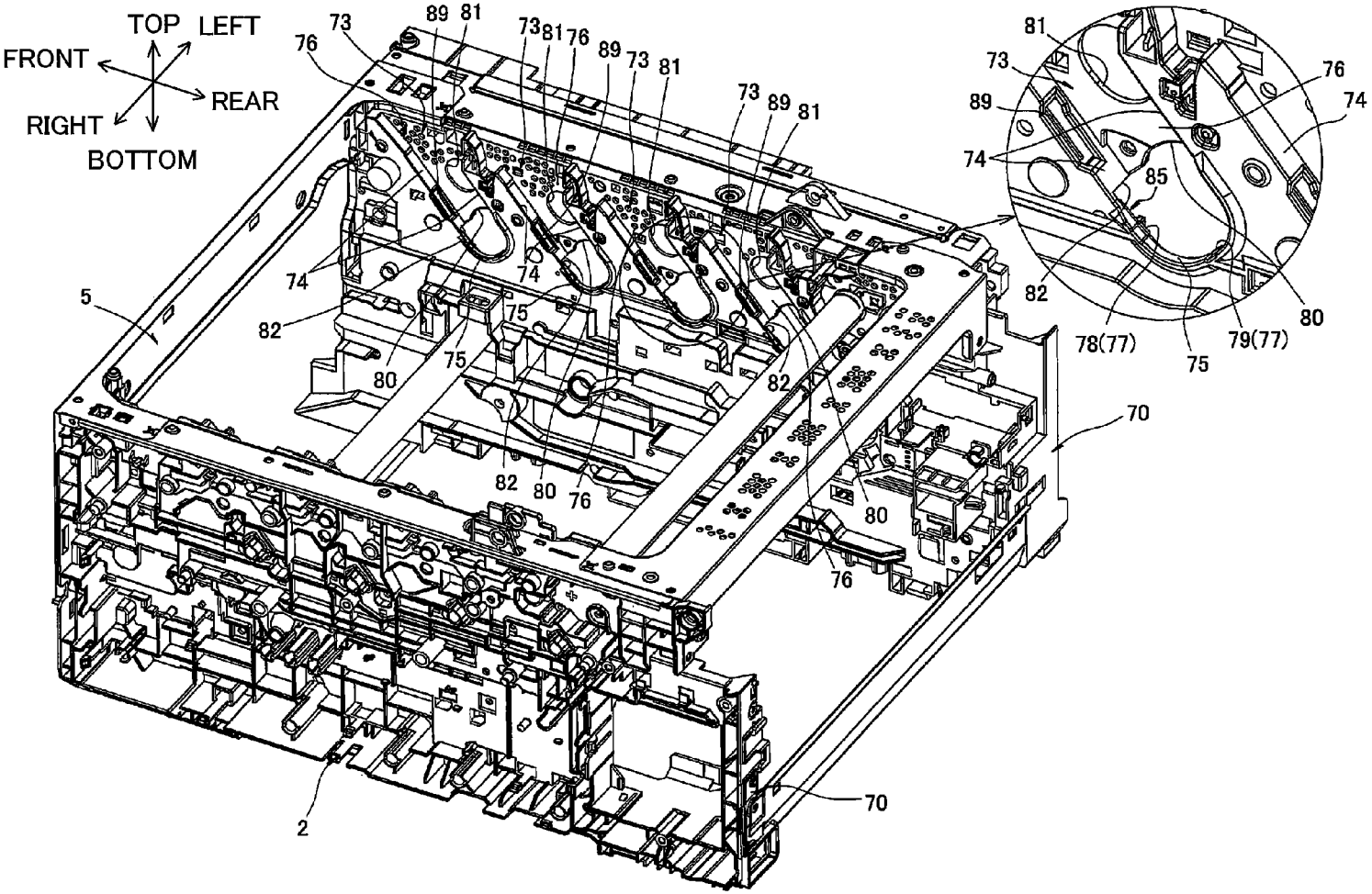
FIG. 3 is a perspective view of a main casing of the printer according to the embodiment of the present invention as viewed from its rear and right side.

As shown in FIG. 3, the main casing 2 has a pair of main side walls 70. The main side walls 70 are arranged parallel to each other and spaced apart in the left-right direction so that one main side wall 70 is disposed on the outside of each of the left and right ends of the process cartridges 13. In the present embodiment, the structure related to a contact/separation locking mechanism 100 described later is provided on each of the main side walls 70 so as to have a symmetrical shape and layout in the left-right direction. Since the structures of the contact/separation locking mechanism 100 are identical, though symmetrical, the following description will focus on the left main side wall 70 and not the right main side wall 70, but will refer to the left main side wall 70 as simply the main side wall 70.

Figure 4:
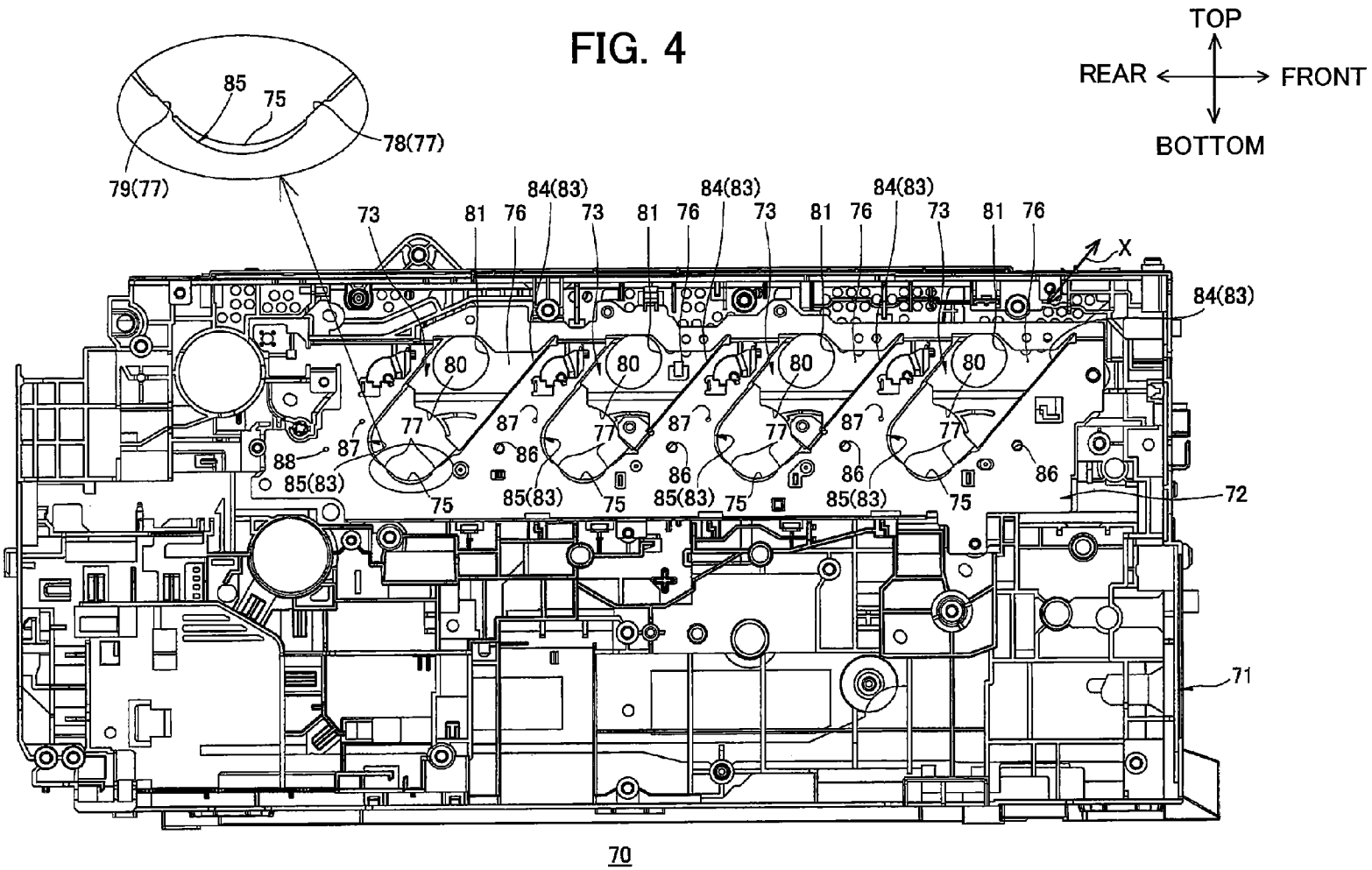
FIG. 4 is a left side view of a left side wall of the main casing of FIG. 3.

As shown in FIG. 4, the main side wall 70 includes a main frame 71, and a drum-support frame 72.

The main frame 71 is formed of polystyrene or another resin material. The main frame 71 has a generally flat plate shape and is substantially rectangular in a side view and elongated in the front-rear direction. The main frame 71 is provided with four bearing guide parts 73, as shown in FIG. 3.

The bearing guide parts 73 are provided to correspond to the four process cartridges 13. The bearing guide parts 73 are arranged parallel to each other and are spaced at intervals in the front-rear direction. Each of the bearing guide parts 73 is formed in a form of a recess extending, from a top edge of the main frame 71, diagonally downward and rearward. The bearing guide parts 73 are thus generally U-shaped in a side view. The bearing guide parts 73 are recessed leftward in the right surface of the main frame 71 and expand leftward from the left surface of the main frame 71.

More specifically, each bearing guide part 73 is integrally configured of a pair of front and rear rail parts 74, a curved part 75, and an enclosing part 76.

Each of the rail parts 74 is shaped to appear bent leftward from the right surface of the main frame 71. The rail parts 74 extend in a direction sloping downward and rearward from the top edge of the main frame 71 (i.e., in a mounting direction X described later, see FIG. 4). The rail parts 74 are spaced apart in the front-rear direction by a distance greater than the outer diameter of the shaft-receiving part 47 on the bearing member 38 (see FIG. 2). The rail parts 74 serve as a track for mounting and removing the corresponding process cartridges 13.

A lever insertion hole 89 is formed in the front rail part 74 (see FIG. 3). The lever insertion hole 89 is formed in an approximate vertical center region of the front rail part 74. The lever insertion hole 89 is generally rectangular in a front view and elongated vertically.

The curved part 75 is provided to connect lower edges of the rail parts 74 and is formed continuously with both lower edges. The curved part 75 is generally V-shaped in a side view with its convex side facing downward (see FIG. 4). The enclosing part 76 is coupled with left edges of the rail parts 74 and the curved part 75.

In each of the bearing guide parts 73 are formed a drum-coupling insertion hole 80, a development-coupling insertion hole 81, and a cutout part 82.

The drum-coupling insertion hole 80 is formed in a lower portion of the enclosing part 76 and penetrates the same. The drum-coupling insertion hole 80 has a general circular shape in a side view.

The development-coupling insertion hole 81 is formed in an upper portion of the enclosing part 76 and is separated from the drum-coupling insertion hole 80 in a direction diagonally above and forward therefrom. The development-coupling insertion hole 81 has a general elliptical shape in a side view and is elongated in a direction sloping downward and rearward. The development-coupling insertion hole 81 penetrates the enclosing part 76 in the left-right direction.

The cutout part 82 is formed by cutting rightward into the left portion of the curved part 75 around the periphery of the drum-coupling insertion hole 80.

As shown in FIG. 4, the drum-support frame 72 is formed through sheet metal processing of metal, such as a steel plate coated with zinc. The drum-support frame 72 has a generally flat plate shape that is substantially rectangular in a side view and elongated in the front-rear direction. The drum-support frame 72 has a vertical dimension approximately one-half of that of the main frame 71. The drum-support frame 72 is disposed on the left side (outer side in the left-right direction) of the main frame 71 and is fixed to the left surface (outer surface in the left-right direction) of the main frame 71 in an upper portion thereof.

Formed in the drum-support frame 72 are four bearing guide holes 83, four contact/separation-lever support holes 86, four locking-member support holes 87, and a linking-member support hole 88.

Four of the bearing guide holes 83 are formed at intervals in the front-rear direction to correspond to the four bearing guide parts 73. The bearing guide holes 83 have a general elliptical shape in a side view and are elongated in a direction sloping downward and rearward (in the mounting direction X described later). The bearing guide holes 83 penetrate the drum-support frame 72 in the left-right direction. Each bearing guide hole 83 has an upper portion serving as a fitting portion 84, and a lower portion serving as a supporting portion 85.

The fitting portion 84 corresponds to the upper portion of the bearing guide part 73, i.e., the pair of rail parts 74, and extends in the mounting direction X described later. The fitting portion 84 has a front-rear dimension that is slightly larger than the distance between the rail parts 74 in the front-rear direction. The upper portion of the corresponding bearing guide part 73 (the pair of rail parts 74 and the upper portion of the enclosing part 76) is fitted into the fitting portion 84.

The supporting portion 85 is formed continuously with a bottom edge of the fitting portion 84 and has a general V-shape in a side view with its convex side facing downward. A pair of positioning protrusions 77 is integrally provided on the supporting portion 85. Referring to FIG. 4, the positioning protrusions 77 are spaced apart in the front-rear direction and protrude into the bearing guide hole 83 from a peripheral edge of the supporting portion 85. The positioning protrusions 77 are generally rectangular in a side view.

More specifically, the front positioning protrusion 77 protrudes diagonally upward and rearward from the front side of the supporting portion 85. The front positioning protrusion 77 has a distal endface that serves as a first receiving surface 78 (see FIG. 3). In a side view, the first receiving surface 78 slopes diagonally downward and rearward.

The rear positioning protrusion 77 protrudes diagonally upward and rearward from the rear portion of the supporting portion 85. The rear positioning protrusion 77 has a distal endface that functions as a second receiving surface 79. In a side view, the second receiving surface 79 slopes in a direction downward and frontward. Hence, the first receiving surface 78 and second receiving surface 79 extend in different directions when viewed from the left or right side.

As shown in FIG. 3, the positioning protrusions 77 protrude into the bearing guide part 73 through the cutout part 82 formed in the curved part 75 such that the positioning protrusions 77 are positioned inward of the inner surface of the curved part 75 of the bearing guide part 73. In other words, the positioning protrusions 77 are disposed such that their distal ends (the first receiving surface 78 and second receiving surface 79) are positioned within the bearing guide part 73 when projected in the left-right direction, as illustrated in FIG. 4.

Four of the contact/separation-lever support holes 86 are spaced at intervals in the front-rear direction, with one contact/separation-lever support hole 86 disposed forward of and separated from the supporting portion 85 of the corresponding bearing guide hole 83. The contact/separation-lever support holes 86 are generally circular in a side view and penetrate the drum-support frame 72 in the left-right direction. The contact/separation-lever support holes 86 have a diameter approximately equal to an outer diameter of a pivot shaft 107 described later.

Four of the locking-member support holes 87 are spaced at intervals in the front-rear direction, with one locking-member support hole 87 disposed rearward of and separated from the supporting portion 85 of the corresponding bearing guide hole 83. The locking-member support holes 87 are generally circular in a side view and penetrate the drum-support frame 72 in the left-right direction. The locking-member support holes 87 have a diameter approximately equal to an outer diameter of a support shaft 123 described later.

The linking-member support hole 88 is formed in the drum-support frame 72 at a position diagonally downward and rearward of the rearmost locking-member support hole 87. The linking-member support hole 88 has a general circular shape in a side view and penetrates the drum-support frame 72 in the left-right direction.

(2) Contact/Separation Locking Mechanism

FIG. 5 shows a contact/separation locking mechanism 100 provided on the main side wall 70. The contact/separation locking mechanism 100 is disposed on the left side of the drum-support frame 72 (the outer side in the left-right direction). The contact/separation locking mechanism 100 includes four contact/separation levers 92, four locking assemblies 93, and a translation cam 94.

(2-1) Contact/Separation Lever

Four of the contact/separation levers 92 are provided to correspond to the four separating members 39. Each contact/separation levers 92 is positioned on the front side of each bearing guide part 73. Each contact/separation lever 92 is integrally provided with a body part 95, a contact/separation pressing part 96, and a cam contact part 97.

In the following description, vertical, front-rear, and left-right directions related to the contact/separation lever 92 will be based on the state of the contact/separation lever 92 when the contact/separation lever 92 is in a contact position described later (see FIGS. 5, 6, 10, and 11). Further, when distinguishing the contact/separation levers 92 based on the corresponding process cartridges 13, the contact/separation lever 92 corresponding to the black process cartridge 13K will be referred to as the black contact/separation lever 92K, while the contact/separation levers 92 corresponding to the three non-black process cartridges 13 (that is, the yellow process cartridge 13Y, magenta process cartridge 13M, and cyan process cartridge 13C) will be referred to as the three contact/separation levers 92YMC. Similarly, the non-black process cartridges 13 will be referred to as the three non-black process cartridges 13YMC.

Figure 11:
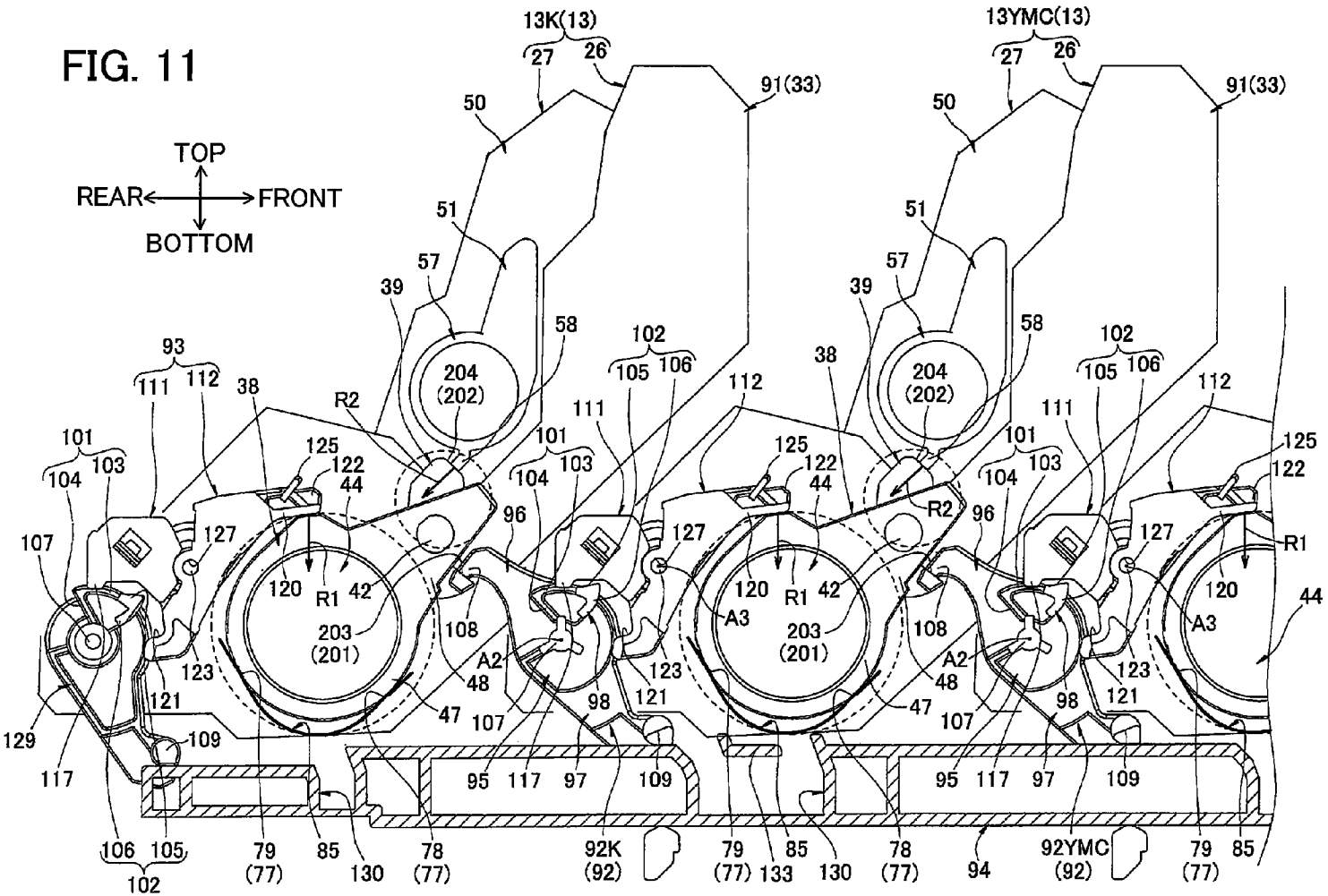
FIG. 11 is an enlarged view of an essential portion of the contact/separation locking mechanism and the black process cartridge shown in FIG. 10.

The body part 95 has a generally flat plate shape that is substantially circular in a side view. As shown in FIG. 11, the body part 95 has a left surface on which a lock interference part 98 is integrally provided.

The lock interference part 98 is provided on the left surface of the body part 95 in an upper portion thereof. The lock interference part 98 is generally fan-shaped in a side view, expanding outward in a radial direction of the body part 95. The lock interference part 98 is formed to protrude leftward from the left surface of the body part 95.

The lock interference part 98 is integrally provided with a first interference part 101 constituting the rear portion, and a second interference part 102 constituting the front portion.

The first interference part 101 has a first arc-shaped part 103, and a first linear part 104. The first arc-shaped part 103 has a general arc-shape in a side view that follows a pivoting path of the contact/separation lever 92 when the contact/separation lever 92 pivots in a pivoting direction R described later (see FIG. 7). The first linear part 104 is formed continuously from a rear end (one end in a circumferential direction) of the first arc-shaped part 103 and extends inward in the radial direction of the body part 95.

The second interference part 102 has a second linear part 105, and a second arc-shaped part 106. The second linear part 105 is formed continuously from a front end (one end in a circumferential direction) of the first arc-shaped part 103 and extends diagonally downward and forward. The second arc-shaped part 106 is formed continuously with a front end of the second linear part 105 and extends inward in the radial direction of the body part 95. The second arc-shaped part 106 is generally arc-shaped in a side view. The second arc-shaped part 106 is separated from the first arc-shaped part 103 in the pivoting direction R (described later). The second interference part 102 has a left-right length greater than that of the first interference part 101.

A pivot shaft 107 is supported in the body part 95. As shown in FIG. 5, the pivot shaft 107 has a general columnar shape that is elongated in the left-right direction. The pivot shaft 107 penetrates a radial center portion of the body part 95 in the left-right direction. The pivot shaft 107 is provided to be rotatable relative to the body part 95.

As shown in FIG. 11, the contact/separation pressing part 96 is formed continuously from an upper rear edge of the body part 95. The contact/separation pressing part 96 has a generally flat plate shape that extends diagonally upward and rearward from the body part 95. The contact/separation pressing part 96 has a top end portion on which a protruding part 108 is integrally provided. The protruding part 108 is generally rectangular in a side view and protrudes diagonally downward and rearward from a bottom surface of the top end portion of the contact/separation pressing part 96.

The cam contact part 97 is formed continuously with a lower front end of the body part 95. The cam contact part 97 has a generally flat plate shape that extends diagonally downward and forward from the body part 95. A boss 109 is integrally provided on a lower end of the cam contact part 97.

Figure 6:
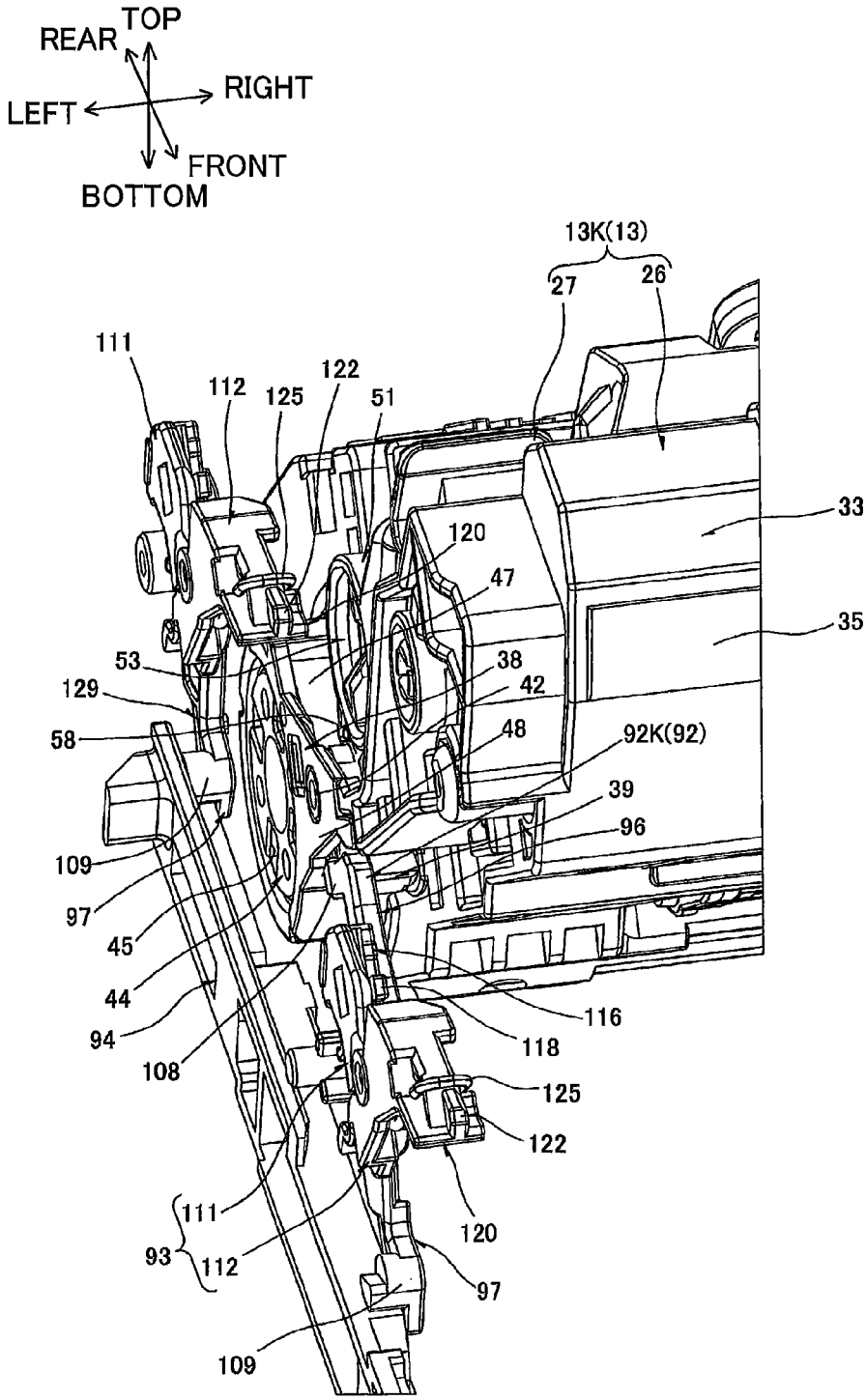
FIG. 6 is a partial perspective view of the contact/separation locking mechanism of FIG. 5 as viewed from its front and left side and shows a positional relationship with the contact/separation locking mechanism and the black process cartridge.

The boss 109 has a general columnar shape that protrudes leftward from a left surface of the lower end of the cam contact part 97 (see FIG. 6). Hence, the boss 109 is disposed on the opposite side of the pivot shaft 107 from the first arc-shaped part 103 (lower side).

Figure 10:
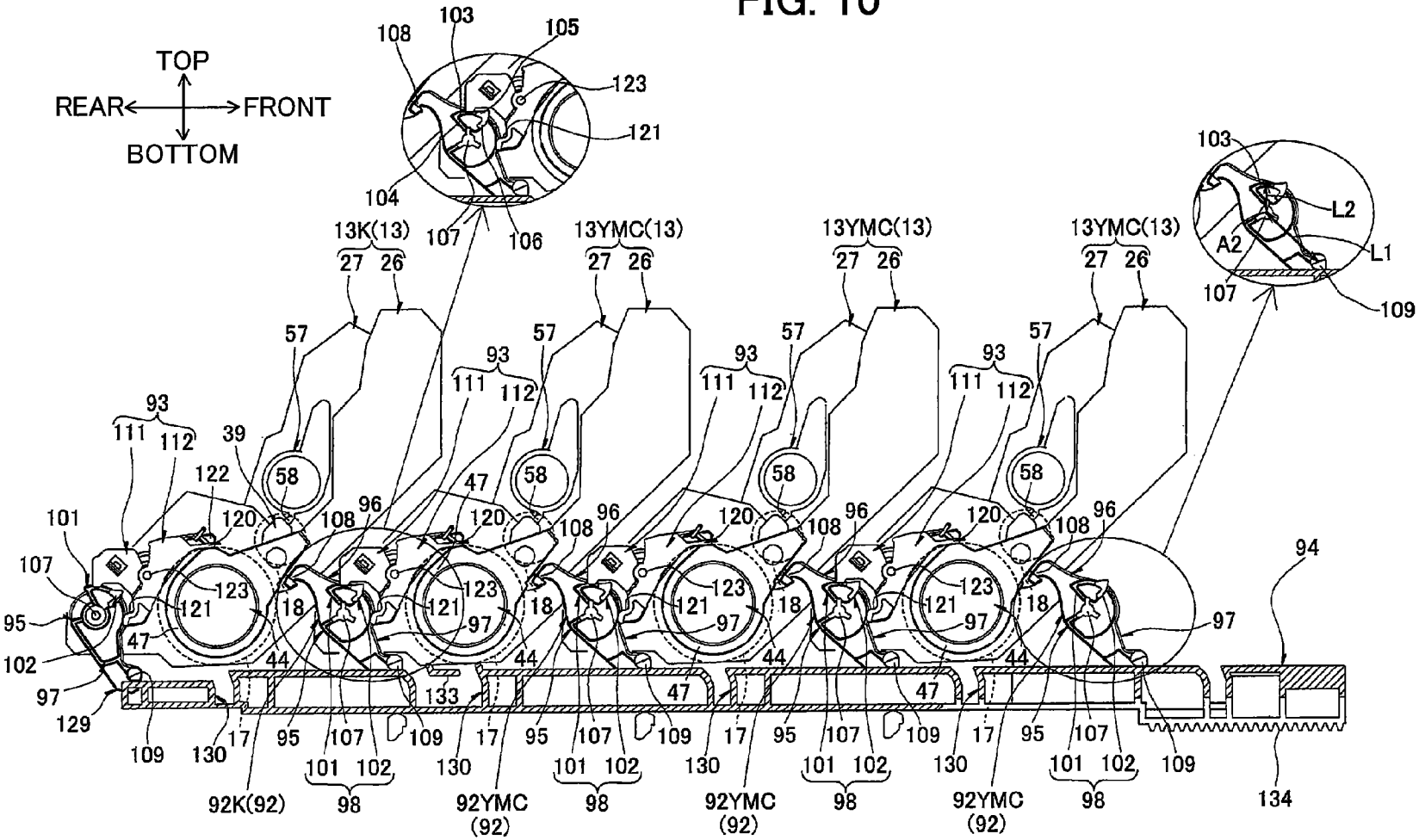
FIG. 10 is a left side view of the contact/separation locking mechanism and the process cartridges, wherein the translation cam is at an all-separated position.

As shown in FIG. 10, assuming a line segment L1 that connects between an axial center of the boss 109 and an axis A2 of the pivot shaft 107 and a line segment L2 that connects between an outer peripheral surface of the first arc-shaped part 103 and the axis A2 of the pivot shaft 107, the line segment L1 has a length greater than the length of the line segment L2 when viewed in the left-right direction. Further, referring to FIG. 6, the boss 109 includes an upper portion and a lower portion, the upper portion having a left-right dimension smaller than that of the lower portion.

The contact/separation lever 92 is supported on the drum-support frame 72 so as to be pivotable relative thereto by fitting a right end of the pivot shaft 107 into the contact/separation-lever support hole 86 formed in the drum-support frame 72 (see FIG. 4) so as to be incapable of rotating relative to the drum-support frame 72. In this way, the contact/separation lever 92 is capable of pivoting about the axis A2 of the pivot shaft 107.

(2-2) Locking Member

As shown in FIG. 5, four of the locking assemblies 93 are provided to correspond to the four photosensitive drums 17. Each locking assembly 93 is disposed rearward of the supporting portion 85 in the corresponding bearing guide hole 83.

In the following description, vertical, front-rear, and left-right directions related to the locking assembly 93 will be given based on the state of the locking assembly 93 when the locking assembly 93 is in a restricting position described later (see FIGS. 5, 6, and 8-11).

Each locking assembly 93 includes a spring support member 111, a locking lever 112, and a spring member 113.

As shown in FIG. 11, the spring support member 111 has a generally flat plate shape that is substantially rectangular in a side view. As shown in FIG. 5, a fitting hole 114 is formed in the spring support member 111.

The fitting hole 114 has a general circular shape in a side view and penetrates a front end portion of the spring support member 111. The fitting hole 114 has a diameter that is approximately equal to an outer diameter of a coupling part 119 described later.

The spring support member 111 is configured of a spring insertion part 115, a spring anchor part 116, and a contact part 117.

The spring insertion part 115 is formed on a right surface of the spring support member 111. The spring insertion part 115 has a general cylindrical shape and protrudes rightward from a peripheral edge of the fitting hole 114.

The spring anchor part 116 is provided on the right surface of the spring support member 111 at a position rearward of the spring insertion part 115. The spring anchor part 116 has a generally flat plate shape that protrudes rightward from the right surface of the spring support member 111 and is elongated in a direction sloping upward and rearward.

The spring anchor part 116 has an upper front surface on which a hook-shaped part 118 is integrally provided. The hook-shaped part 118 protrudes diagonally upward and forward from an approximate front-rear center region on the upper front surface of the spring anchor part 116. The hook-shaped part 118 has a distal end that is bent leftward so that the hook-shaped part 118 has a hook-like shape in cross section.

As shown in FIG. 11, the contact part 117 is generally rectangular in a side view and protrudes downward from a bottom edge of the spring support member 111 at the rear side thereof.

As shown in FIG. 5, the spring support member 111 supports the spring member 113.

The spring member 113 is a torsion coil spring formed of an electrically conductive material, such as metal. A middle portion of the spring member 113 is wounded multiple times to form a coil part 124. Specifically, the spring member 113 is integrally configured of the coil part 124, a locking-lever urging part 125 and a separating-lever urging part 126.

The coil part 124 has an air-core coil shape that extends in the left-right direction. The coil part 124 has an inner diameter larger than an outer diameter of the spring insertion part 115.

The locking-lever urging part 125 is formed continuously from the right end of the coil part 124 in a linear shape that extends obliquely upward and forward, then bends leftward.

The separating-lever urging part 126 is formed continuously with the left end of the coil part 124 in a linear shape that extends obliquely upward and rearward.

The spring member 113 is disposed on the right side of the spring support member 111 and is supported on the spring support member 111 by inserting the spring insertion part 115 into the coil part 124 from the left side thereof. The separating-lever urging part 126 of the spring member 113 is disposed on the upper front surface of the spring anchor part 116 and is anchored by the hook-shaped part 118.

As shown in FIG. 11, the locking lever 112 has a generally flat plate shape that extends in a direction sloping downward and rearward. A shaft insertion hole 127 is formed in the locking lever 112.

The shaft insertion hole 127 has a general circular shape in a side view and penetrates the locking lever 112 in an approximate vertical center thereof. The shaft insertion hole 127 has a diameter that is approximately equal to the outer diameter of a support shaft 123 described later.

As shown in FIG. 5, the locking lever 112 is integrally configured of a coupling part 119, an advancing/retracting part 120, and a contact groove 121.

The coupling part 119 is formed on a right surface of the locking lever 112. The coupling part 119 has a general cylindrical shape and protrudes rightward from a peripheral edge of the shaft insertion hole 127.

As shown in FIG. 11, the advancing/retracting part 120 has a generally flat plate shape that is substantially rectangular in a plan view. The locking lever 112 has an upper end portion from whose front end the advancing/retracting part 120 protrudes forward. As shown in FIG. 6, a protruding part 122 is integrally provided on the advancing/retracting part 120. The protruding part 122 has a generally flat plate shape that is substantially rectangular in a side view and protrudes upward from a top surface of the advancing/retracting part 120.

As shown in FIG. 11, the locking lever 112 has a lower rear edge portion on which the contact groove 121 is formed. The contact groove 121 has a general V-shape in a side view and is recessed in a direction obliquely downward and forward.

As shown in FIG. 5, the locking lever 112 is coupled to the spring support member 111 by inserting the coupling part 119 of the locking lever 112 into the fitting hole 114 of the spring support member 111 from the left side thereof. Here, the coupling part 119 and spring insertion part 115 share the same axis.

As shown in FIG. 5, the locking-lever urging part 125 of the spring member 113 (distal end of the locking-lever urging part 125 that bends leftward) is disposed obliquely upward and forward of the protruding part 122 formed on the advancing/retracting part 120. With this configuration, the spring member 113 urges the spring support member 111 and locking lever 112 away from each other. More specifically, the separating-lever urging part 126 urges the contact part 117 of the spring support member 111 in a direction obliquely downward and rearward, while the locking-lever urging part 125 urges the advancing/retracting part 120 of the locking lever 112 in a direction obliquely downward and forward.

As shown in FIG. 11, each of the locking assemblies 93 is angularly movably supported to the drum-support frame 72 by a support shaft 123 so as to be capable of rotating relative to the drum-support frame 72. The support shaft 123 has a general columnar shape and extends with its axis oriented in the left-right direction.

In other words, by inserting the support shaft 123 through the shaft insertion hole 127 of the locking lever 112 so that the locking lever 112 can rotate relative to the support shaft 123 and by inserting the support shaft 123 through the locking-member support hole 87 formed in the drum-support frame 72 (see FIG. 4) so that the support shaft 123 cannot rotate relative to the drum-support frame 72, the spring support member 111 and locking lever 112 are angularly movably supported to the drum-support frame 72. Thus, each of the spring support member 111 and locking lever 112 can pivotally move about an axis A3 of the support shaft 123, as shown in FIG. 11. Thus, due to the urging force of the spring member 113, the locking assembly 93 moves about the support shaft 123 in a butterfly manner. Further, the advancing/retracting part 120 is positioned above the axis A3, while the contact groove 121 is positioned below the axis A3

As shown in FIG. 10, the locking assemblies 93 corresponding to the three non-black process cartridges 13YMC are disposed one each obliquely above and forward of a corresponding contact/separation lever 92.

In this way, the contact/separation lever 92 and locking assembly 93 of each set are juxtaposed in the front-rear direction between the shaft-receiving parts 47 of neighboring process cartridges 13. In other words, at least a portion of each of the contact/separation lever 92, locking assembly 93, and shaft-receiving part 47 overlaps one another in a front-rear projection. As shown in FIG. 11, the pivot shaft 107 of the contact/separation lever 92 is positioned so that its axis A2 does not fall within the locking assembly 93 in a left-right projection. Similarly, the support shaft 123 of the locking assembly 93 is positioned so that its axis A3 does not fall within the contact/separation lever 92 in a left-right projection.

As shown in FIG. 10, a linking member 129 is disposed on the lower rear side of the locking assembly 93 corresponding to the black process cartridge 13K, i.e., the rearmost locking assembly 93. The linking member 129 has a structure identical to that of the contact/separation levers 92 described above, except that the contact/separation pressing part 96 is omitted. In other words, the linking member 129 is integrally provided with the body part 95 and cam contact part 97 described above.

The linking member 129 is pivotably movably supported on the drum-support frame 72 by inserting the pivot shaft 107 into the linking-member support hole 88 formed in the drum-support frame 72 (see FIG. 4) so as to be incapable of rotating relative to the drum-support frame 72. The linking member 129 and locking assemblies 93 are all juxtaposed in the front-rear direction, as illustrated in FIG. 5. Further, the pivot shaft 107 of the linking member 129 is not aligned with the locking assembly 93 in a left-right projection. Similarly, the support shaft 123 of the locking assembly 93 is not aligned with the linking member 129 in a left-right projection.

(2-3) Translation Cam

As shown in FIG. 5, the translation cam 94 is supported on the left surface of the drum-support frame 72 (see FIG. 4) beneath the four contact/separation levers 92 and the linking member 129 such that the translation cam 94 is capable of sliding in the front-rear direction. The translation cam 94 has a general parallelepiped shape and is elongated in the front-rear direction. A plurality of (five) engaging grooves 130 is formed in the translation cam 94.

The five engaging grooves 130 are provided to correspond to the four contact/separation levers 92 and the linking member 129. The engaging grooves 130 are spaced at intervals in the front-rear direction. The engaging grooves 130 have a generally square U-shape in a side view and are recessed into the top surface of the translation cam 94. Each engaging groove 130 has a rear surface whose upper portion slopes rearward toward the top.

Each engaging groove 130 has a front-rear dimension greater than the outer diameter of the boss 109 provided on the contact/separation lever 92. Further, the engaging groove 130 corresponding to the black contact/separation lever 92K has a larger front-rear dimension than that of the engaging grooves 130 of the remaining three contact/separation levers 92YMC.

A rib 133 is provided inside the engaging groove 130 corresponding to the black contact/separation lever 92K. The rib 133 is generally rectangular in a side view and elongated in the front-rear direction. The rib 133 protrudes rightward from a left surface of the engaging groove 130.

The translation cam 94 has a front end portion on whose bottom surface a rack gear 134 is provided. The rack gear 134 engages with a pinion gear (not shown) provided in the main casing 2.

4. Operations for Mounting and Positioning Process Cartridges in the Main Casing and for Removing Process Cartridges from the Main Casing Next, operations for mounting the process cartridge 13 in the main casing 2 and for positioning the process cartridge 13 relative to the main casing 2, as well as operations for removing the process cartridge 13 from the main casing 2, will be described.

In order to mount the process cartridge 13 in the main casing 2, an operator places the top cover 6 in the open position to expose the access opening 5. As the top cover 6 is opened, the translation cam 94 moves to its rearmost position according to an interlocking mechanism well known in the art. This is a mounting/removal allowing position shown in FIG. 7.

When the translation cam 94 is in the mounting/removal allowing position, the bosses 109 of all contact/separation levers 92 and the linking member 129 are fitted in the corresponding engaging grooves 130 and positioned farther rearward than the corresponding pivot shafts 107. Accordingly, the contact/separation levers 92 and the linking member 129 are oriented in a direction sloping downward and rearward (the mounting direction X described later). Consequently, the protruding part 108 of each contact/separation lever 92 is retracted inside the bearing guide part 73 to a position separated from and frontward of the corresponding lever insertion hole 89 (see FIG. 3). Hence, when the translation cam 94 is disposed in the mounting/removal allowing position, all contact/separation levers 92 are in their retracted position retracted from the mounting/removal paths of the process cartridges 13 (hereinafter referred to simply as the "paths of the process cartridges 13").

Further, in the linking member 129 and the three contact/separation levers 92 other than the forwardmost contact/separation lever 92, the rear end of the first interference part 101 (the outer end of the first linear part 104 in the radial direction of the body part 95) is positioned frontward of the contact part 117 in the spring support member 111, and the front end of the second interference part 102 (the outer end of the second arc-shaped part 106 in the radial direction of the body part 95) contacts the bottom edge on the contact groove 121 of the locking lever 112 from obliquely above and rearward thereof. As a result, all of the locking levers 112 are oriented vertically and thus the advancing/retracting parts 120 of the locking levers 112 are positioned in separation from and rearward of the cutout parts 82 (see FIG. 3). Hence, all of the locking assemblies 93 are disposed in their non-restricting positions (see FIG. 7) in which the advancing/retracting parts 120 of the locking levers 112 are retracted from the paths of the process cartridges 13.

That is, when the translation cam 94 is disposed in the mounting/removal allowing position, all contact/separation levers 92 are in their retracted position and all locking assemblies 93 are in their non-restricting position. Thus, all of the contact/separation levers 92 and locking assemblies 93 are retracted from the paths of the process cartridges 13.

Next, the operator places the process cartridge 13 above the desired position of the main casing 2 and inserts the process cartridge 13 diagonally downward and rearward so that the shaft-receiving parts 47 of the left and right bearing members 38 are fitted into the corresponding bearing guide parts 73 (see FIG. 3). At this time, the shaft-receiving parts 47 are guided by the rail parts 74 (see FIG. 3) and the process cartridge 13 moves diagonally downward and rearward in the mounting direction X shown in FIG. 7.

When the shaft-receiving parts 47 of the bearing members 38 arrive at the respective curved parts 75, as shown in FIG. 11, the curved parts 75 restrict further downward movement of the process cartridge 13. At this time, the process cartridge 13 is in its mounted position inside the main casing 2.

Next, the operator returns the top cover 6 from its open position to its closed position (shown in FIG. 1), completing the operations for mounting the process cartridge 13 in the main casing 2.

As will be described later in greater detail, the translation cam 94 is subsequently moved to a multicolor operating position (described later) by a drive source (not shown). As a result, the locking assemblies 93 are moved from their non-restricting position to their restricting position. In this way, the shaft-receiving parts 47 of the bearing members 38 are fixed in position on the positioning protrusions 77 of the drum-support frames 72, thereby fixing the position of the process cartridge 13 in the main side walls 70. At this time, the first receiving surface 78 of the front positioning protrusion 77 contacts the shaft-receiving part 47 on its lower front side, while the second receiving surface 79 on the rear positioning protrusion 77 contacts the shaft-receiving part 47 on its lower rear side. Accordingly, the flange members 44 on the photosensitive drum 17 are restricted from moving relative to the drum-support frames 72 through the shaft-receiving parts 47.

Through the process described above, the operations for mounting the process cartridge 13 in the main casing 2 and for positioning the process cartridge 13 relative to the main casing 2 are complete. Operations for releasing the position of the process cartridge 13 and for removing the process cartridge 13 from the main casing 2 are achieved by performing the operations for mounting and positioning the process cartridge 13 in reverse order.

More specifically, the translation cam 94 is moved from the multicolor operating position described later to the mounting/removal allowing position by moving the top cover 6 from its closed position to its open position. Moving the translation cam 94 in this way releases the process cartridge 13 from its position relative to the main side walls 70, enabling the flange members 44 of the photosensitive drum 17 to be moved relative to the drum-support frames 72.

Figure 7:
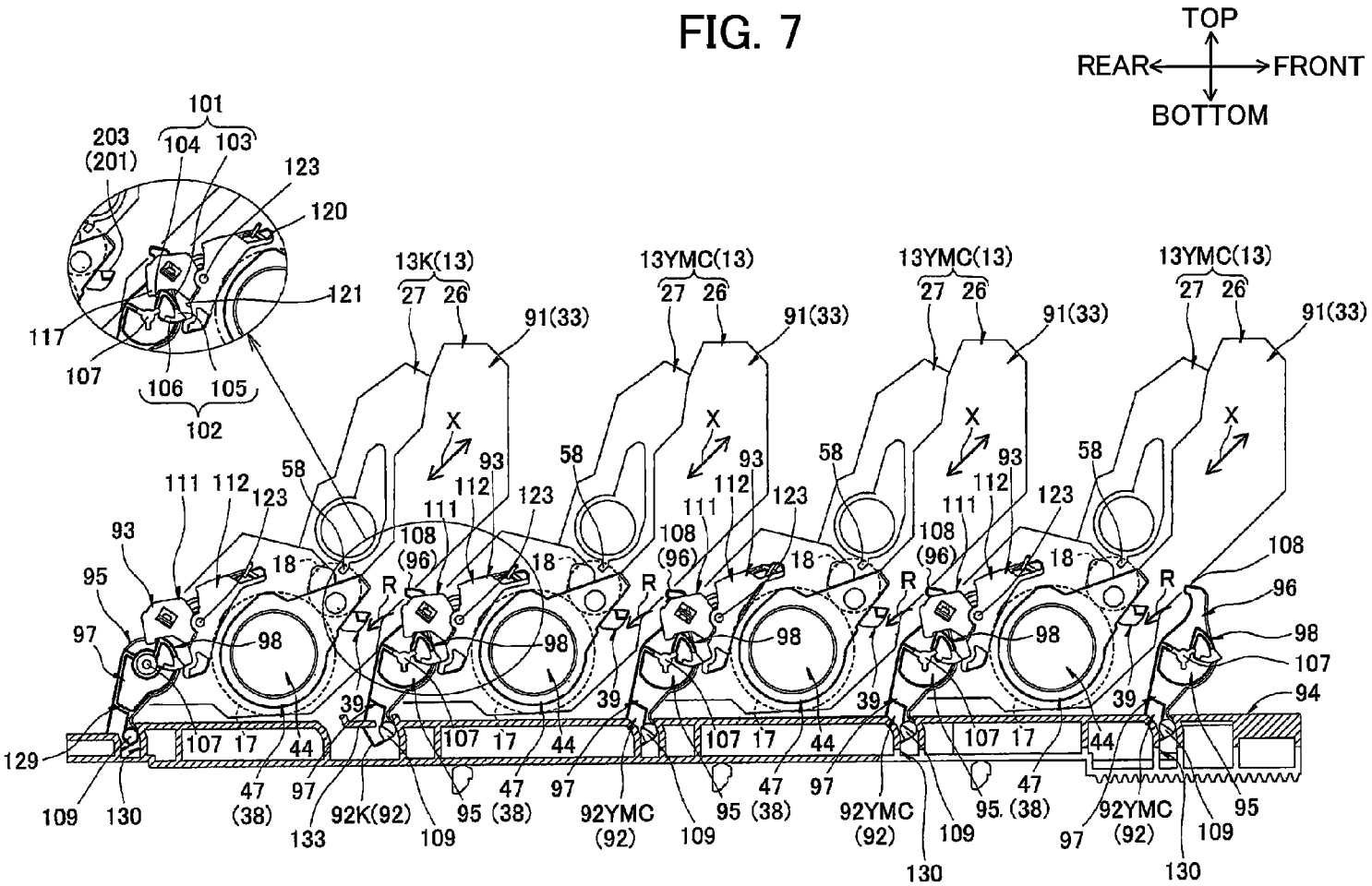
FIG. 7 is a left side view of the contact/separation locking mechanism and the process cartridges, wherein a translation cam of the contact/separation locking mechanism is at a mounting/removal allowing position.

Next, the operator pulls the process cartridge 13 diagonally upward and forward from the main casing 2 in the mounting direction X shown in FIG. 7 as the shaft-receiving parts 47 are guided by the bearing guide parts 73 (see FIG. 3). Through this operation, the process cartridge 13 is removed from the main casing 2.

5. Operations for Placing Developing Rollers in Contact with the Photosensitive Drums and for Separating the Developing Rollers from the Photosensitive Drums Next, operations for placing the developing rollers 18 in contact with and separating the developing rollers 18 from the corresponding photosensitive drums 17 will be described.

The operating mode on the printer 1 can be switched among a color mode for forming color images, a monochrome mode for forming images in black only, and a warm-up mode to perform preparations for image formation (for example, cleaning the surfaces of the photosensitive drums 17).

Figure 8:
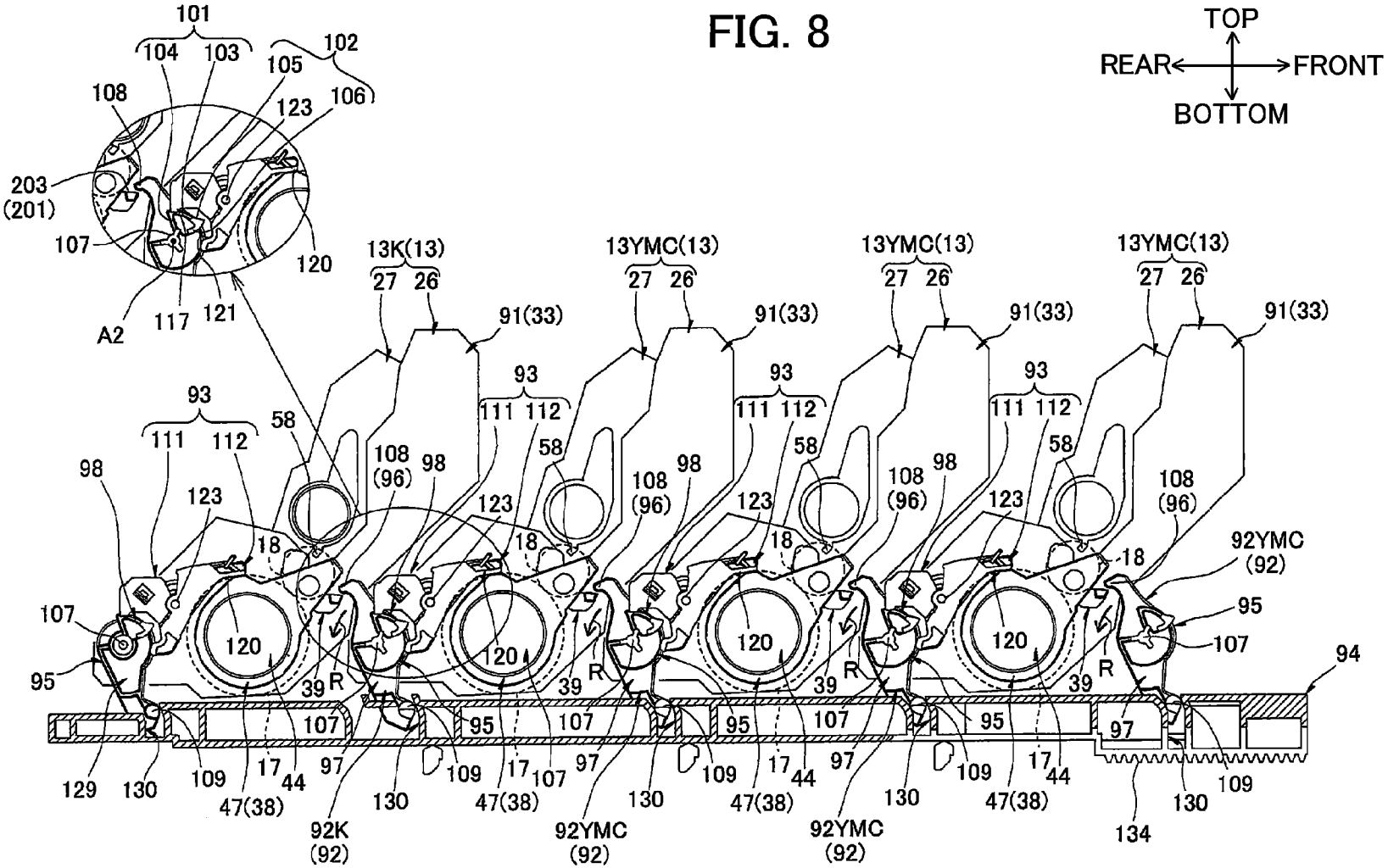
FIG. 8 is a left side view of the contact/separation locking mechanism and the process cartridges, wherein the translation cam is at a multicolor operating position.

In the color mode, the developing cartridges 27 of all process cartridges 13 are disposed in their contact positions, as shown in FIG. 8.

Figure 9:
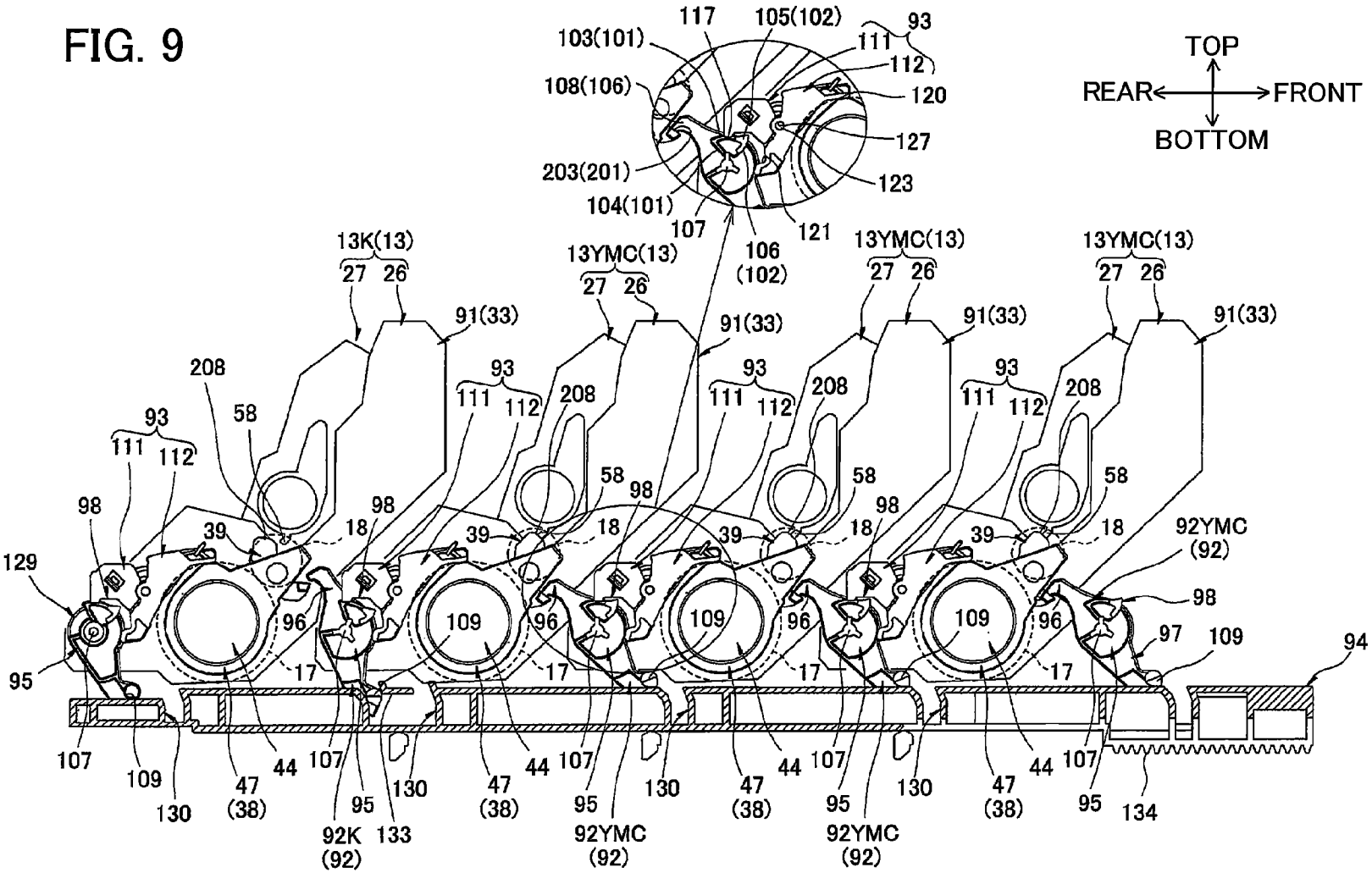
FIG. 9 is a left side view of the contact/separation locking mechanism and the process cartridges, wherein the translation cam is at a monochrome operating position.

In the monochrome mode, only the developing cartridge 27 of the black process cartridge 13K is disposed in its contact position, as shown in FIG. 9. The developing cartridges 27 of the other three non-black process cartridges 13YMC are disposed in their separated positions.

In the warm-up mode, the developing cartridges 27 of all process cartridges 13 are disposed in their separated positions, as shown in FIG. 10.

On the other hand, while the developing cartridges 27 of all process cartridges 13 are accommodated in the developing-cartridge-accommodating sections 91 of the corresponding drum-cartridge frames 33, as shown in FIG. 7, the pressing members (not shown) constantly press the developing cartridges 27 into their contact positions. Hence, in order to move the developing cartridges 27 suitably into their contact positions or separated positions, the translation cam 94 is moved forward from the mounting/removal allowing position, moving the contact/separation levers 92 from their retracted position into a pressure release position or a pressing position.

In order to move the translation cam 94, a drive force from a motor or other drive source (not shown) provided in the main casing 2 is inputted into the rack gear 134 of the translation cam 94 through the pinion gear (not shown) provided in the main casing 2. This drive force moves the translation cam 94 forward from the mounting/removal allowing position to one of the multicolor operating position, monochrome operating position, and all-separated position as needed.

(1) Multicolor Operating Position

When a drive force is transmitted to the translation cam 94, the translation cam 94 moves forward from the mounting/removal allowing position, as illustrated in FIGS. 7 and 8. When the translation cam 94 moves forward, the front end of the rib 133 contacts the lower portion of the boss 109 provided on the black contact/separation lever 92K, moving the boss 109 forward. At the same time, the rear surfaces defining the engaging grooves 130 contact the bosses 109 provided on the three contact/separation levers 92YMC and the linking member 129 and move these bosses 109 forward. Consequently, all contact/separation levers 92 and the linking member 129 pivotally move counterclockwise in a left side view about the corresponding pivot shafts 107. This direction in which the contact/separation levers 92 and linking member 129 pivotally move will be called the pivoting direction R.

As the contact/separation levers 92 and the linking member 129 move in the pivoting direction R, the rear end of each first interference part 101 (the outer end of the first linear part 104 in the radial direction of the body part 95) pushes the front end of the contact part 117 on the corresponding spring support member 111 obliquely upward and rearward. As a result, the spring support members 111 pivot clockwise in a left side view about their support shafts 123 and against the urging force of the spring members 113 (see FIG. 5). As each spring support member 111 pivots, the first arc-shaped part 103 of the corresponding first interference part 101 arrives at a position beneath the corresponding contact part 117, as shown in FIG. 8, such that the contact part 117 is in contact with the convex side of the first arc-shaped part 103. Through this contact between the contact part 117 and the first arc-shaped part 103, the separating-lever urging part 126 of the corresponding spring member 113 (see FIG. 5) urges the first interference part 101 toward the axis A2 of the pivot shaft 107.

As the spring member 113 applies a force to the first arc-shaped part 103 of the first interference part 101, the locking lever 112 pivots clockwise in a left side view about the corresponding support shaft 123 and the advancing/retracting part 120 of the locking lever 112 advances through the cutout part 82 into the bearing guide part 73, i.e., into the path of the corresponding process cartridge 13. At this time, the locking assembly 93 is in the restricting position.

Thus, as the translation cam 94 slides from the mounting/removal allowing position toward the multicolor operating position, the first the contact/separation lever 92 is pivotally moved in the pivoting direction R and subsequently the locking lever 112 of the locking assembly 93 is moved in response to the pivotal movement of the contact/separation lever 92.

While the locking assembly 93 is disposed in the restricting position, the advancing/retracting part 120 contacts the top of the shaft-receiving part 47 of the corresponding bearing member 38, as shown in FIG. 11. The locking-lever urging part 125 of the spring member 113 (see FIG. 5) applies an urging force R1 to the shaft-receiving part 47 for urging the shaft-receiving part 47 downward. As will be described later, the shaft-receiving part 47 of the bearing member 38 is restricted from moving relative to the drum-support frame 72 because the advancing/retracting part 120 pushes the shaft-receiving part 47 toward the pair of positioning protrusions 77. Hence, by means of the shaft-receiving part 47, the flange member 44 is restricted from moving relative to the drum-support frame 72.

As shown in FIG. 8, the protruding part 108 of each contact/separation lever 92 protrudes through the corresponding lever insertion hole 89 (see FIG. 3) into the corresponding bearing guide part 73. Each protruding part 108 confronts the upper front end of the pressure-receiving surface 203 in the corresponding separating member 39 with a gap formed therebetween. In this state, the translation cam 94 is disposed in the multicolor operating position and all contact/separation levers 92 are disposed in the pressure release position. Accordingly, movement of the translation cam 94 is halted. While the contact/separation lever 92 is in the pressure release position, the second arc-shaped part 106 of the corresponding lock interference part 98 opposes the contact groove 121 of the corresponding locking lever 112 in the pivoting direction R with a gap formed therebetween.

At this point, the process of moving the translation cam 94 from the mounting/removal allowing position to the multicolor operating position is complete.

While the translation cam 94 is in the multicolor operating position, all contact/separation levers 92 are disposed in their pressure release positions. Accordingly, the developing cartridges 27 of all process cartridges 13 are in their contact positions, setting the operating mode of the printer 1 to the color mode.

Note that the operation described above may be performed in reverse to move the translation cam 94 from the multicolor operating position back to the mounting/removal allowing position. As the translation cam 94 moves rearward from the multicolor operating position (see FIG. 8), all of the contact/separation levers 92 pivot in a direction opposite the pivoting direction R (clockwise in a left side view), as shown in FIG. 7. The pivotal movement of each contact/separation lever 92 separates the corresponding contact part 117 from the first arc-shaped part 103 and brings the second arc-shaped part 106 of the lock interference part 98 into contact with the contact groove 121 formed in the locking lever 112 of the locking assembly 93 from the upper rear side thereof. Consequently, the corresponding locking lever 112 pivotally moves counterclockwise in a left side view about the support shaft 123. Through this process, the contact/separation levers 92 are placed in their retracted positions and the locking assemblies 93 are moved to their non-restricting position.

(2) Monochrome Operating Position

When a drive force continues to be transmitted to the translation cam 94, the translation cam 94 moves further forward from the multicolor operating position, as illustrated in FIGS. 8 and 9. As the translation cam 94 moves forward, the bosses 109 of the three contact/separation levers 92YMC and the linking member 129 slide up and over the rear surfaces of the corresponding engaging grooves 130 until they are supported on the top surface of the translation cam 94 at positions to the rear of the corresponding engaging grooves 130.

As the bosses 109 move out of the engaging grooves 130 onto the top surface of the translation cam 94, the three contact/separation levers 92YMC pivotally move counterclockwise in a left side view (i.e., in the pivoting direction R) from the pressure release position to the pressing position. As a result, the protruding parts 108 of the three contact/separation levers 92YMC apply pressure to the pressure-receiving surfaces 203 on the separating members 39 of the corresponding three non-black process cartridges 13YMC, forcing the separating members 39 of the three non-black process cartridges 13YMC to pivot clockwise in a left side view about their support shafts 42.

The contact surfaces 204 on the pivoting separating members 39 contact the rear surfaces of the corresponding separation contact parts 58 (separation contact parts 65), pushing the separation contact parts 58 (separation contact parts 65) in a direction obliquely upward and forward. As a result, the developing cartridges 27 corresponding to the three non-black process cartridges 13YMC move obliquely upward and forward against the force of the pressing members (not shown) and are placed in their separated positions.

Note that the boss 109 of the black contact/separation lever 92K remains inside the corresponding engaging groove 130 at this time, and the black contact/separation lever 92K remains in the pressure release position. Hence, only the developing cartridge 27 of the black process cartridge 13K remains in the contact position, while the developing cartridges 27 of the other three non-black process cartridges 13YMC are placed in their separated positions. Through this configuration, the translation cam 94 is disposed in the monochrome operating position, thereby setting the operating mode of the printer 1 to the monochrome mode.

Further, as each separating member 39 pushes the corresponding separation contact part 58 (separation contact part 65) in a direction obliquely upward and forward, a reaction force R2 acts on the separating member 39 in a direction obliquely downward and rearward, as illustrated in FIG. 11. The reaction force R2 acts on the support shaft 42 through the separating member 39 and in turn on the drum-cartridge frame 33. Hence, the reaction force R2 urges the shaft-receiving part 47 of the bearing member 38 in a direction obliquely downward and rearward, as will be described later.

(3) All-Separated Position

When a drive force is further transmitted to the translation cam 94, the translation cam 94 moves further forward from the monochrome operating position, as illustrated in FIGS. 9 and 10. As the translation cam 94 moves forward, the boss 109 on the black contact/separation lever 92K slides up and over the rear surface of the engaging groove 130 and becomes supported on the top surface of the translation cam 94 at a position rearward of the corresponding engaging groove 130. As the boss 109 of the black contact/separation lever 92K moves out of the engaging groove 130, the black contact/separation lever 92K pivots counterclockwise in a left side view (i.e., in the pivoting direction R) from the pressure release position to the pressing position. Consequently, as with the three contact/separation levers 92YMC, the protruding part 108 on the black contact/separation lever 92K presses against the pressure-receiving surface 203 on the corresponding separating member 39, as shown in FIG. 11, and the separating member 39 pushes the separation contact part 58 (separation contact part 65) in a direction obliquely upward and forward.

As a result, the developing cartridge 27 corresponding to the black process cartridge 13K moves into its separated position against the force of the pressing members (not shown). At this time, all developing cartridges 27 are disposed in their separated positions.

Hence, when each locking assembly 93 is placed in its restricting position, the process cartridge 13 positioned on the front side of the locking assembly 93 is restricted from moving relative to the drum-support frame 72. Further, when the contact/separation lever 92 is placed in its pressing position, the developing cartridge 27 of the process cartridge 13 positioned on the rear side of the contact/separation lever 92 is moved to the separated position.

Through the above process, the translation cam 94 is disposed in the all-separated position, setting the operating mode of the printer 1 to the warm-up mode.

Further, when the separating member 39 presses the separation contact part 58 (separation contact part 65) obliquely upward and forward, the reaction force R2 acting in a direction obliquely downward and rearward is applied to the separating member 39. As described above, the reaction force R2 urges the shaft-receiving part 47 of the corresponding bearing member 38 downward and rearward, urging the flange member 44 through the shaft-receiving part 47 of the bearing member 38 toward the second receiving surface 79 of the positioning protrusion 77. In other words, the second receiving surface 79 is disposed downstream of the flange member 44 and shaft-receiving part 47 with respect to the direction in which the reaction force R2 acts (hereinafter referred to as a "reaction force direction R2").

As described above, the urging force R1 of the locking-lever urging part 125 in each spring member 113 causes the locking lever 112 of the corresponding locking assembly 93 to push the corresponding shaft-receiving part 47 downward. Hence, through the shaft-receiving part 47, the flange member 44 is urged into a position between the first receiving surface 78 and second receiving surface 79 in the front-rear direction.

6. Operations and Technical Advantages (1) The contact/separation locking mechanism 100 shown in FIG. 5 is provided on each main side wall 70 of the printer 1. As shown in FIGS. 7 and 9, the contact/separation locking mechanism 100 is provided with locking assemblies 93 that angularly move between the restricting position (see FIG. 8) and the non-restricting position (see FIG. 7), and contact/separation levers 92 that move the corresponding developing rollers 18 between the contact position (see FIG. 8) for contacting the corresponding photosensitive drum 17, and the separated position (see FIG. 9) for separating from the photosensitive drum 17. Hence, by pivotally moving the contact/separation levers 92 while the locking assemblies 93 are in their restricting position, the developing rollers 18 can be placed in contact with the corresponding photosensitive drums 17 or separated therefrom while restricting movement of the flange members 44 (axial ends of the photosensitive drums 17) relative to the drum-support frames 72, as shown in FIGS. 8 and 9.

As shown in FIG. 6, the locking assembly 93 and contact/separation lever 92 are juxtaposed in the front-rear direction (orthogonal direction). As shown in FIG. 11, the support shaft 123 serving as the pivot center of the locking assembly 93 is positioned so as not to overlap the contact/separation lever 92 when projected in the left-right direction (axial direction), and the pivot shaft 107 serving as the pivot center of the contact/separation lever 92 is positioned so as not to overlap the locking assembly 93 in the left-right projection. Hence, the locking assemblies 93 and contact/separation levers 92 can be arranged in a manner to reduce the amount of overlap between the two in the left-right projection. As a result, it is possible to reduce the amount of space in the left-right direction required for disposing the locking assemblies 93 and contact/separation levers 92, thereby making the main casing 2 more compact in the left-right direction and, hence, making the printer 1 more compact in the left-right direction.

Thus, the structure of the embodiment can place the developing rollers 18 in contact with the photosensitive drums 17 and separate the developing rollers 18 from the photosensitive drums 17 while the photosensitive drums 17 are restricted from moving relative to the main casing 2 and can also make the printer 1 more compact in the left-right direction.

(2) As illustrated in FIGS. 7 through 10, the locking assemblies 93 and contact/separation levers 92 are pivotally moved by sliding the translation cam 94 in the front-rear direction. This configuration can associate the pivotal movements of the locking assemblies 93 and contact/separation levers 92 and, hence, can achieve a more compact structure for pivoting both the locking assemblies 93 and contact/separation levers 92 and require fewer parts than when separate structures are provided for moving the locking assemblies 93 and the contact/separation levers 92.

(3) When the translation cam 94 is slid from the mounting/removal allowing position to the multicolor operating position as illustrated in FIGS. 7 and 8, first the contact/separation levers 92 are pivotally moved in the pivoting direction R, and subsequently the locking levers 112 of the locking assemblies 93 are angularly moved in response to the pivotal movement of the contact/separation levers 92. Hence, the angular movement of the locking assemblies 93 can be reliably associated with the pivotal movement of the contact/separation levers 92, and the locking assemblies 93 can be moved from their restricting position (see FIG. 8) to their non-restricting position (see FIG. 7) at a desired timing.

(4) As shown in FIG. 5, each locking assembly 93 includes the locking lever 112. As shown in FIG. 11, the locking lever 112 has the advancing/retracting part 120 positioned above the support shaft 123 (on one end of the locking lever 112), and the contact groove 121 positioned below the support shaft 123 (on the other end of the locking lever 112). Hence, when the lock interference part 98 of the contact/separation lever 92 contacts or separates from the contact groove 121, the advancing/retracting part 120 advances into and retracts from the bearing guide part 73 through the cutout part 82, as illustrated in FIG. 7. In other words, the advancing/retracting part 120 advances into and retracts from the path of the corresponding process cartridge 13.

Accordingly, the above structure can reliably transmit the pivotal movement of the contact/separation lever 92 to the locking lever 112 in order to angularly move the corresponding locking assembly 93 reliably between its restricting position and non-restricting position.

(5) As shown in FIG. 11, each locking assembly 93 is provided with the spring support member 111, which is integrally provided with the contact part 117. The locking assembly 93 can be reliably disposed in its restricting position by the contact of the lock interference part 98 of the contact/separation lever 92 and the contact part 117 of the spring support member 111. On the other hand, since pivotal movement of the spring support member 111 is allowed when the lock interference part 98 of the contact/separation lever 92 separates from the contact part 117 of the spring support member 111, the locking assembly 93 can move from the restricting position to the non-restricting position.

In this way, the locking assembly 93 can be reliably disposed in its restricting position while the contact part 117 and lock interference part 98 are in contact and can be allowed to move from the restricting position to the non-restricting position by separating the lock interference part 98 of the contact/separation lever 92 from the contact part 117.

(6) As shown in FIG. 5, the locking assembly 93 (spring support member 111) also includes the spring member 113. While the contact part 117 of the spring support member 111 is in a state of contact with the lock interference part 98 of the contact/separation lever 92, the spring member 113 can place the advancing/retracting part 120 of the locking lever 112 inside the bearing guide part 73 (into the path of the process cartridge 13) through the cutout part 82, as shown in FIG. 3. Hence, through a simple construction, the locking assembly 93 can be placed in its restricting position while the contact part 117 is in contact with the lock interference part 98.

Accordingly, the locking assembly 93 can be restricted from moving from its restricting position to its non-restricting position during an image-forming operation, and the flange members 44 on the photosensitive drum 17 can be reliably suppressed from moving relative to the drum-support frames 72.

(7) As shown in FIG. 5, the separating-lever urging part 126 of the spring member 113 urges the lock interference part 98 toward the pivot center of the contact/separation lever 92 (the axis A2 of the pivot shaft 107; see also FIG. 11) through contact between the contact part 117 and the first arc-shaped part 103 of the lock interference part 98. With this configuration, the advancing/retracting part 120 of the locking lever 112 can be reliably advanced into the bearing guide part 73 through the cutout part 82 while the contact part 117 is in contact with the first arc-shaped part 103 of the lock interference part 98, as shown in FIG. 11.

If the contact part 117 were to urge the contact/separation lever 92 in a direction following the pivoting direction R of the spring member 113, the biasing force of the spring member 113 could encourage or hinder pivotal movement of the contact/separation lever 92. However, the contact part 117 urges the contact/separation lever 92 toward the axis A2 of the pivot shaft 107. This configuration suppresses any encouragement or hindrance in the pivoting of the contact/separation lever 92, ensuring that the translation cam 94 for pivotally moving the contact/separation levers 92 slides smoothly.

(8) As shown in FIG. 11, the lock interference part 98 is provided on each contact/separation lever 92. The lock interference part 98 has the first arc-shaped part 103 and the second arc-shaped part 106. When the contact/separation lever 92 is pivotally moved, the first arc-shaped part 103 contacts the contact part 117 and the second arc-shaped part 106 separates from the contact groove 121 in the pivoting direction R, placing the locking assembly 93 in its restricting position. Further, by pivoting the contact/separation lever 92 as shown in FIG. 7, the first arc-shaped part 103 separates from the contact part 117 and the second arc-shaped part 106 contacts the contact groove 121, placing the locking assembly 93 in its non-restricting position. Thus, the locking assembly 93 can be reliably disposed in its restricting position and non-restricting position by pivotally moving the contact/separation lever 92.

(9) As shown in FIG. 10, each contact/separation lever 92 includes the boss 109. Through contact between the bosses 109 and the translation cam 94, the sliding movement of the translation cam 94 can be reliably associated with pivotal movements of the contact/separation levers 92. When viewed in the left-right direction, the length of the line segment L1 between the axial center of the boss 109 and the axis A2 of the pivot shaft 107 is longer than the length of the line segment L2 between the peripheral surface of the first arc-shaped part 103 and the axis A2 of the pivot shaft 107. This configuration reduces the amount of force that must be applied to the bosses 109 in order to pivotally move the contact/separation levers 92.

Thus, the above construction can reliably associate pivotal movement of the contact/separation levers 92 with sliding movement of the translation cam 94 while ensuring that the translation cam 94 moves smoothly.

(10) As shown in FIG. 4, the bearing guide holes 83 are formed in the drum-support frame 72, and the pair of positioning protrusions 77 is provided on the supporting portion 85 of each bearing guide hole 83. Thus, when the process cartridge 13 is mounted in the main casing 2, as shown in FIG. 11, the flange members 44 of the photosensitive drum 17 are positioned with precision, as the shaft-receiving part 47 is in contact with the first receiving surface 78 and second receiving surface 79 of the positioning protrusions 77. This construction can improve the precision in positioning each photosensitive drum 17 relative to the drum-support frame 72.

(11) Further, when the locking assembly 93 is disposed in its restricting position shown in FIG. 11, the flange member 44 is pressed toward the position between the first receiving surface 78 and second receiving surface 79 through the shaft-receiving part 47. Accordingly, by disposing the locking assembly 93 in its restricting position, the structure of the preferred embodiment restricts movement of the flange member 44 of the photosensitive drum 17 relative to the drum-support frame 72, further improving the precision in positioning the photosensitive drum 17 relative to the drum-support frame 72.

(12) As shown in FIG. 11, the separating member 39 is supported on the support shaft 42 of the drum-cartridge frame 33. Accordingly, the reaction force R2 produced when the separating member 39 presses the separation contact part 58 (separation contact part 65) obliquely upward and forward acts on the drum-cartridge frame 33. Since the second receiving surface 79 is disposed downstream of the flange member 44 on the photosensitive drum 17 in the reaction force direction R2, the shaft-receiving part 47 of the drum-cartridge frame 33 is urged toward the second receiving surface 79 by the reaction force R2. Accordingly, the shaft-receiving part 47 is supported on both the first receiving surface 78 and the second receiving surface 79 and is thereby positioned relative to the positioning protrusions 77.

In this way, the flange member 44 of the photosensitive drum 17 is positioned relative to the drum-support frame 72 through the shaft-receiving part 47. As a result, the position of the photosensitive drum 17 relative to the drum-support frame 72 is maintained constant, even when the developing roller 18 is moved into contact with and separated from the photosensitive drum 17.

(13) As shown in FIG. 1, the four process cartridges 13 are arranged parallel to each other and spaced apart in the front-rear direction within the main casing 2. A space is allocated between neighboring process cartridges 13. The locking assemblies 93 and contact/separation levers 92 are then juxtaposed in the front-rear direction within the spaces formed between the shaft-receiving parts 47 (axial ends) of neighboring process cartridges 13, as illustrated in FIGS. 10 and 11 (see also FIG. 6).

Further, when disposed in its restricting position, each locking assembly 93 fixes, relative to the drum-support frame 72, the positions of the shaft-receiving part 47 in the process cartridge 13 that is positioned to the front side of the locking assembly 93. When disposed in its pressing position, each contact/separation lever 92 presses against the separating member 39 of the process cartridge 13 positioned to the rear side of the contact/separation lever 92 to move the corresponding developing cartridge 27 into its separated position. That is, in terms of the two neighboring process cartridges 13, the locking assembly 93 acts on the process cartridge 13 positioned on the front side, while the contact/separation lever 92 acts on the process cartridge 13 positioned on the rear side.

If both of the locking assembly 93 and the contact/separation lever 92 were to act on only one of the neighboring process cartridges 13, a space for allowing both of the locking assembly 93 and the contact/separation lever 92 to function could be required on one side of the process cartridge 13 in the front-rear direction. However, in the present embodiment, the locking assembly 93 acts on one of the neighboring process cartridge 13, while the contact/separation lever 92 acts on the remaining one of the neighboring process cartridges 13. Hence, with regard to each of the neighboring process cartridges 13, a space for the locking assembly 93 only is conserved on one side of the process cartridge 13 while a space for the contact/separation lever 92 only is conserved on another side of the process cartridge 13 in the front-rear direction.

This construction ensures an efficient layout of the locking assemblies 93 and contact/separation levers 92 in order to conserve space in the main casing 2 and, hence, to make the printer 1 more compact.

7. Variations and Modifications

The printer 1 is an example of the image forming apparatus according to the embodiment of the present invention. However, other than the depicted direct horizontal tandem-type color printer, the present invention may also be applicable to an intermediate-transfer type tandem color printer provided with a plurality of photosensitive members, an intermediate transfer body, and transfer members, or to a monochrome printer provided with one process cartridge.

Further, although the depicted process cartridge 13 is configured of the drum cartridge 26 and the developing cartridge 27 detachably mountable on the drum cartridge 26, the process cartridge 13 may instead be configured of a drum cartridge and a developing cartridge that are integral with each other.

Further, the developing cartridge 27 may be configured such that a toner cartridge accommodating toner is detachable mountable in a frame supporting the developing roller 18.

With these constructions, the above-described operations and technical advantages can be achieved.

Note that the constructions of depicted embodiment and the variations can be combined appropriately as need.

While the invention has been described in detail with reference to the specific embodiment thereof, it would be apparent to those skilled in the art that various changes and modifications may be made therein without departing from the spirit of the invention.

What is claimed is:

1. An image forming apparatus comprising:

a main casing; and a cartridge attachable to and detachable from the main casing, the cartridge comprising:

a photosensitive drum defining a drum axis extending in an axial direction and configured to rotate about the drum axis; and a developing roller disposed to oppose the photosensitive drum, wherein the main casing comprises:

a metal frame configured to support the cartridge and provided with a positioning portion of a generally V-shape when viewed in the axial direction, the positioning portion having a first surface and a second surface each extending in a direction different from each other and configured to restrict the photosensitive drum from moving relative to the metal frame when the cartridge is mounted in the main casing;

a lock member movably supported to the metal frame, attaching and detaching of the cartridge relative to the main casing being performed along a path, the lock member being configured to move about a first axis between a restricting position and a non-restricting position, the lock member at the restricting position protruding into the path and restricting the photosensitive drum from moving relative to the metal frame, and the lock member at the non-restricting position being retracted from the path and allowing the photosensitive drum to move relative to the metal frame; and a contact-separation member movably supported to the metal frame and configured to move a second axis between a contact position and a separation position, the contact-separation member at the contact position causing the developing roller to contact the photosensitive drum and the contact-separation member at the separation position causing the developing roller to be separated from the photosensitive drum, the lock member and the contact-separation member being aligned in an orthogonal direction orthogonal to the axial direction such that at least one of a first condition and a second condition is satisfied, wherein the first condition is the first axis not being overlapped with the contact-separation member when viewed in the axial direction, and wherein the second condition is the second axis not being overlapped with the lock member when viewed in the axial direction.

2. The image forming apparatus as claimed in claim 1, wherein the main casing further comprises a reciprocating member configured to slide in the orthogonal direction to cause the lock member and the contact-separation member to move in an interlocking manner.

3. The image forming apparatus as claimed in claim 2, wherein sliding of the reciprocating member in the orthogonal direction causes the contact-separation member to pivot, and movement of the contact-separation member causes the lock member to angularly move.

4. The image forming apparatus as claimed in claim 3, wherein the lock member comprises a lever configured to angularly move relative to the metal frame about the first axis, the lever comprising:

an advancing/retracting portion configured to protrude into and retract from the path of the cartridge; and a contact portion configured to contact and separate from the contact-separation member, the advancing/retracting portion and the contact portion being positioned opposite to each other with respect to the first axis.

5. The image forming apparatus as claimed in claim 4, wherein the lock member further comprises an engaging member configured to angularly move relative to the metal frame about the first axis, the engaging member having an abutment portion configured to abut on and separate from the contact-separation member.

6. The image forming apparatus as claimed in claim 5, wherein the lock member further comprises a biasing member configured to bias the lever and the engaging member away from each other.

7. The image forming apparatus as claimed in claim 6, wherein the biasing member is configured to bias the abutment portion toward the second axis of the contact-separation member.

8. The image forming apparatus as claimed in claim 5, wherein the contact-separation member is configured to pivotally move relative to the metal frame about the second axis in a pivoting direction and comprises:

an abutted portion configured to abut on the abutment portion of the engaging member; and a contacted portion positioned spaced apart from the abutted portion in the pivoting direction and configured to contact the contact portion of the lever, wherein the lock member is at the restricting position when the abutment portion and the abutted portion are in abutment with each other and the contact portion is separated from the contacted portion, and wherein the lock member is at the non-restricting position when the abutment portion is separated from the abutted portion and the contact portion is in contact with the contacted portion.

9. The image forming apparatus as claimed in claim 8, wherein the contact-separation member further comprises an interlocking portion positioned opposite to the abutted portion with respect to the second axis of the contact-separation member, the interlocking portion being configured to be in direct contact with the reciprocating member and move in conjunction with the sliding of the reciprocating member, and wherein the interlocking portion and the second axis of the contact-separation member defines a first distance therebetween and the abutted portion and the second axis of the contact-separation member defines a second distance therebetween, the first distance being longer than the second distance.

10. The image forming apparatus as claimed in claim 1, wherein the photosensitive drum has an end portion in the axial direction, and wherein the lock member is configured to press the end portion of the photosensitive drum toward a position between the first surface and a second surface when the lock member is at the restricting position.

11. The image forming apparatus as claimed in claim 1, wherein the cartridge further comprises:

a drum frame configured to accommodate the photosensitive drum therein; and a developing frame configured to accommodate the developing roller therein, wherein the drum frame has an axial end portion and an operating portion provided on the axial end portion, the operating portion being configured to act on the developing frame in a first direction parallel to the path such that the developing roller is separated from the photosensitive drum, acting of the operating portion on the developing frame in the first direction generating a reaction force acting in a second direction opposite to the first direction, and wherein either one of the first surface and the second surface is positioned downstream of the axial end portion of the drum frame in the second direction and configured to support the cartridge mounted in the main casing.

12. The image forming apparatus as claimed in claim 1, wherein the cartridge comprises a plurality of cartridges juxtaposed and spaced away from one another in the orthogonal direction within the main casing, the plurality of cartridges including a first cartridge and a second cartridge arranged adjacent to each other, wherein the lock member is configured to act on the first cartridge such that the first cartridge is restricted from moving relative to the metal frame, and wherein the contact-separation member is configured to act on the second cartridge such that the developing roller of the second cartridge is separated from the photosensitive drum of the second cartridge.

* * * * *